US005678442A

United States Patent [19]

Ohba et al.

[11] Patent Number: 5,678,442

[45] Date of Patent: Oct. 21, 1997

[54] EXTRUDER

[75] Inventors: Hiroyoshi Ohba; Hideki Iwai, both of Yamaguchi, Japan

[73] Assignee: Ube Industries, Ltd., Ube, Japan

[21] Appl. No.: 656,523

[22] Filed: May 31, 1996

[30] Foreign Application Priority Data

| | | | |
|---|---|---|---|
| Jun. 27, 1995 | [JP] | Japan | 7-160888 |
| Aug. 29, 1995 | [JP] | Japan | 7-220131 |
| Oct. 31, 1995 | [JP] | Japan | 7-283510 |
| Dec. 8, 1995 | [JP] | Japan | 7-320649 |

[51] Int. Cl.[6] ..... B21C 27/00

[52] U.S. Cl. ..... 72/272; 72/273; 72/342.3

[58] Field of Search ..... 72/272, 273, 273.5, 72/270, 264, 342.2

[56] References Cited

U.S. PATENT DOCUMENTS

| | | | |
|---|---|---|---|
| 3,360,975 | 1/1968 | Edgecombe | 72/342.3 |
| 3,364,707 | 1/1968 | Foerster | 72/342.3 |
| 3,455,137 | 7/1969 | Edgecombe | 72/342.3 |
| 4,399,676 | 8/1983 | Noyori et al. | 72/273.5 |
| 4,475,372 | 10/1984 | Ostlinning et al. | 72/273.5 |
| 4,606,211 | 8/1986 | Noyori et al. | 72/273.5 |
| 5,445,004 | 8/1995 | Nannini et al. | 72/272 |
| 5,461,899 | 10/1995 | Sorheim et al. | 72/272 |

FOREIGN PATENT DOCUMENTS

| | | | |
|---|---|---|---|
| 48-25315 | 7/1973 | Japan . | |
| 55-19605 | 9/1976 | Japan . | |
| 52-47556 | 4/1977 | Japan . | |
| 0002613 | 2/1979 | Japan | 72/272 |
| 3-413 | 1/1991 | Japan . | |
| 3-81214 | 8/1991 | Japan . | |
| 5-245533 | 9/1993 | Japan . | |

OTHER PUBLICATIONS

"Speciale Feature on Section", Current Technological Situation, Sepbermber Edition, pp. 76–76.

*Primary Examiner*—Lowell A. Larson
*Assistant Examiner*—Ed Tolan
*Attorney, Agent, or Firm*—Kanesaka & Takeuchi

[57] ABSTRACT

An extruder has a cylindrical container into which a billet is loaded; a two-piece seal block disposed on an end surface of the container at an extruding stem side; a vacuum deaerating hole formed in the seal block; and a fixed dummy block, having an internal cooling function, fixed to an end of the extruding stem, wherein the seal block is allowed to be opened and closed in a direction perpendicular to the axial direction of the container and the seal block comes in close contact with an outer surface of the extruding stem and the end surface of the container when the seal block is closed.

19 Claims, 22 Drawing Sheets

EXTRUDER

FIELD OF THE INVENTION AND RELATED ART STATEMENT

The present invention relates to an extruder, for extruding materials such as aluminum alloys by an extrusion press, which can eliminate air trapped between a container and a billet to the outside of the container until the billet is extruded from the inside of the container through a die, thereby reducing the idle time and providing an end product in which no blow hole of air is included.

After a billet is inserted into a container wherein inner diameter is slightly larger than that of the billet, the billet is pressed against the die with an extruding stem from the rear side of the container and is "upset" so that the billet is pressed to be deformed to compress air trapped between the container and the billet. For eliminating the compressed air, the extruding stem and the container are backed slightly and the compressed air is released into the atmosphere through a space formed between the die and the container. After that, the extrusion is started by advancing the container and the extruding stem once again. The breathing step for eliminating compressed air as mentioned above is referred to as a "verp cycle", which causes a waste of time in the extrusion cycle.

Moreover, this process remains air in a small space like a film at atmospheric pressure between the inner surface of the container and the outer surface of the billet when the container is pressed against the die after the verp cycle. That is, the sufficient deaeration can not be obtained by this process.

Then, there is a method as disclosed in Japanese Patent Publication No. 48-25315 to enable residual air to be easily and securely eliminated. In this process, the residual air is eliminated by providing metallic bellows to form a sealed chamber between a container and an extruding stem, sealing by metallic packing between one end of the bellows and the container and between the other end and the extruding stem by metallic packing, and pressing the metallic packing from the outside by a cylinder using air or fluid to eliminate air in the sealed chamber to the outside.

Japanese Unexamined Published Patent Application No. 52-47556 discloses a method of vacuum deaeration from a container through a space formed between a dummy block and the container with the inside of the container being sealed with sealing material, through a supporting member being sealingly in contact with the disc-like supporting plates arranged in suitable positions of an extruding stem with carbon sealant elastically by a spring disposed between the rear wall of the container and the supporting plates.

Moreover, Japanese Utility Model Publication No. 55-19605 discloses an extruder provided with a two-piece seal block allowed to open and close in a direction perpendicular to the axial direction of a container. In this extruder, the inner surface of the seal block comes into close contact with the outer surface of an extruding stem when the seal block closes.

Such a two-piece seal block opens and closes along a guide plate fixed to upper and lower portions of an end surface of the container at the extruding stem side. In addition, sealing members for sealing the container from the extruding stem are arranged between a cover plate and the seal block and between the extruding stem and the inner surface of the seal block, respectively. The container is provided with a deaerating groove at an upper portion thereof at the extruding stem side, thereby facilitating deaeration.

Furthermore, Japanese Unexamined Published Patent Application No. 5-245533 discloses a device comprising a rim, coming into contact with an end surface of a container at an extruding stem side, and an elastic member of telescopic type sealed by edges thereof which are slidable against the extruding stem to keep a hermetically sealed enclosure to be pressed against the end surface of the container over the full stroke of the extruding press device. Air in the container is vacuumed after sealed by bringing the rim into contact with the end surface of the container by stretching the elastic member of the telescopic type.

However, the methods disclosed in Japanese Patent Publication No. 48-25315 and Japanese Unexamined Published Patent Application No. 52-47556 have following problems. Since the methods are devised to completely eliminate the residual air in the container for the extrusion of the billet, the seal is accomplished by a flexible sealing device such as a metallic bellows expandable from the extruding stem side toward the rear end of the container. Therefore, the wider deaerating capacity is needed at the end of the container or there must be a space for rising of the billet loader, thereby increasing the idle time.

In addition to the insufficiency of air elimination, a main cause of blisters is the increased temperature of a fixed dummy block, which performs extrusion upon abutting against the billet, at the working surface side thereof. The temperature of the fixed dummy block is increased by heat retained in the billet heated upon continuously performing hot extrusions.

Once the temperature of the fixed dummy block at the working surface side is increased by heat received from the billet of aluminum alloy during the extrusion of the billet, impurities and/or blisters included in the outer portion of the billet, may flow into the inside of the end product by backward entrainment due to the metal flow. The entrainment of the impurities and/or blisters makes the yield of the end product lower. Particularly in case of extruding aluminum alloys, it has been observed from our experience that when the temperature of the working surface of the fixed dummy block is cooled around 250° C., the metal flow is prevented, thereby making occurrence of blisters difficult.

In Unexamined Published Utility Model Application No. 3-81214, a cooler for a fixed dummy block is disposed between a container and an extruding stem to spray coolant against an working surface of the fixed dummy block. It is, however, difficult to cool the working surface of the fixed dummy block to lower the temperature thereof from 450° C. to 200° C. through 300° C. during the stand-by period between the extrusion presses which is approximately 20 minutes so that a lot of blisters are entrained into the end product, thereby making the yield of the end product lower.

Additionally, there are the following problems related to Japanese Patent Publication No. 48-25315, Japanese Unexamined Published Patent Application No. 52-47556, and Japanese Unexamined Published Patent Application No. 5-245533 cited above.

(1) Since the flexible sealing device, such as a metallic bellows, a spring, or a telescopic elastic member, which is expandable from the extruding stem side toward the rear end of the container is used to seal the container to completely eliminate the residual air within the container for the extrusion of the billet, it necessitates a larger deaerating space and a longer deaerating time, and the atmosphere is easily entered into the container because of insufficient sealing, thereby the degree of vacuum lower.

(2) The sealing device is backed to a ram (a base portion of the extruding stem) side during loading the billet into the container and then the inside of the container is sealed by advancing the sealing device after the billet is completely loaded by the forward movement of the extruding stem, thereby making the idle time longer for the operation of the sealing device.

(3) Since the flexible sealing device is stretched from the backmost position of the base of the extruding stem to the end surface of the container, the front portion of the seal device is deformed so as to make a space between the end surface of the container and the seal device, thereby deteriorating the sealing performance.

(4) It needs large pressure to press the sealing device from the ram side to the container so that the container comes in sufficiently contact with the end surface of the container, thereby making the structure complex.

(5) In a condition that the flexible sealing device is compressed at the backmost position, the extruding press device is longer than the conventional extruding stem (conventionally, the extending stem necessitates a length sufficiently for extruding the billet loaded in the container) for the size of the sealing device in the compressed state, thereby increasing the whole length of the extruding press and thus necessitating a wider area for installing the extruding press.

(6) According to Japanese Unexamined Published Patent Application No. 52-47556 or Japanese Unexamined Published Patent Application No. 5-245533, the sealing device moves relatively to the extruding stem with the sealing device being always in contact with the extruding stem, thereby wearing sealing materials and the contact surfaces between the sealing device and the extruding stem and decreasing their lives.

(7) In the case of (6), the front portion of the sealing device is deformed, so that the sealing device easily interfere with the extruding stem, thereby further decreasing their lives.

There are the following problems related to Japanese Utility Model Publication No. 55-19605.

i) The two-piece seal block opens and closes along the guide plate disposed on the end surface of the container. The sealing members disposed between the seal block and the guide plate receive heat from the container during opening and closing of the seal block, is exposed to high temperature (for example more than 300° C. ) by holding heat in air heated in the container and moreover rubs against the guide plate, therefore significantly deteriorating the sealing members and decreasing the lives.

ii) When the extruding stem is backed to the original position after completion of extrusion of the billet, for scrapping off aluminum residues by the fixed dummy block fixed to the end of the extruding stem, the scrapped aluminum residues enter into a groove of the guide plate so that the seal block is difficult to open and close, thereby deteriorating sealing performance.

iii) Since the deaerating groove is formed in the inner surface of the container, i.e. the upper portion of the inner surface of the container at the extruding stem side, such a container is not allowed to be used in a general purpose extruder because of the limitation so that the container must be exchanged with another one without deaerating groove whenever used for another purpose, thereby taking a lot of time for exchanging containers.

iv) The container liner is exerted with large external force during upsetting the billet so that a portion where the deaerating groove is formed is exerted with concentrated load, thereby decreasing the mechanical strength.

OBJECT AND SUMMARY OF THE INVENTION

The present invention is achieved in consideration of the problems of prior art as mentioned above. It is an object of the present invention to provide an extruding cycle in which a container is sealed just before air in the container is completely eliminated before extruding a billet in the container, without a step of deaerating before extruding the billet from a die, called as the verp cycle. It is another object of the present invention to provide an extruder which cools a rear end portion of a billet to prevent the metal flow, thereby preventing residual air and impurities from entering into the billet and thus preventing the deterioration of the quality and yield of end products.

For achieving the objects mentioned above, according to a first aspect, an extruder comprises a cylindrical container into which a billet is loaded; a two-piece seal block disposed on an end surface of the container at an extruding stem side; a vacuum deaerating hole formed in the seal block; and a fixed dummy block, having an internal cooling function, fixed to an end of the extruding stem, wherein the seal block is allowed to be opened and closed in a direction perpendicular to the axial direction of the container and the seal block comes in close contact with an outer surface of the extruding stem and the end surface of the container when the seal block is closed.

The billet in the container is pressed from the rear side against the die by the extruding stem so that the billet is squeezed and air trapped between the container and the billet is compressed. The compressed air must be vacuumed from the rear side of the container before the billet is squeezed from the die. In addition, air must be vacuumed from the container just before the end of the billet comes into contact with the die. According to the present invention, air in the container is forcibly vacuumed from the extruding stem side before the billet is compressed by the extruding stem, thereby omitting the step for eliminating compressed air, called as a breathing.

The fixed dummy block fixed to the working-side end of the extruding stem is cooled inside thereof before vacuuming the air from the container and then air in the container is vacuumed with the container being sealed by the seal block disposed on the end surface of the container at the extruding stem side to open and close in the direction perpendicular to the axial direction of the container so that air trapped between the container and the billet can be easily vacuumed as well as the metal flow of the billet is prevented, thereby significantly improving the yield of the end products without blister.

According to a second aspect, an extruder comprises a container having a container liner into which a billet is loaded; a ring-like protrusion disposed on an end surface of the container at an extruding stem side; and a two-piece seal block being opened and closed in a direction perpendicular to the axial direction of the extruding stem; wherein the seal block comes into close contact with an outer surface of the ring-like protrusion and an outer surface of the extruding stem at the same time when the seal block is closed. According to a third aspect, on the basis of the second aspect, the seal block is provided with a vacuum deaerating hole for eliminating residual air in the container wherein the vacuum deaerating hole is connected to a vacuum pump. According to a fourth aspect, on the basis of the second aspect, the seal block is provided with sealing material having heat resistance and resiliency attached to a contact surface of the seal block which come into contact with each other when the seal block is closed. According to a fifth aspect, on the basis of the second aspect, when the seal block is opened, the seal block can be moved not to interfere with a billet loader on which the billet to be loaded is placed and not to interfere with the exchange of the container.

The billet in the container is pressed from the rear side against the die by the extruding stem so that the billet is squeezed and air trapped between the container and the billet is compressed. The compressed air must be vacuumed from the rear side of the container before the billet is squeezed from the die. In addition, air must be vacuumed from the container just before the end of the billet comes into contact with the die. According to the present invention, the air in the container is forcibly vacuumed from the extruding stem side before the billet is compressed by the extruding stem, thereby omitting the step for eliminating compressed air, called as a breathing.

Air in the container is vacuumed with the container being sealed by the seal block disposed on the end surface of the container at the extruding stem side to open and close in the direction perpendicular to the axial direction of the container so that air trapped between the container and the billet can be easily vacuumed as well as the metal flow of the billet is prevented, thereby significantly improving the yield of the end products without blister.

According to a sixth aspect, an extruder comprises a container having a container liner into which a billet is loaded; a ring-like protrusion disposed on an end surface of the container at an extruding stem side; a ring-like seal block comprising a pair of seal block pieces disposed above a portion, at the container side, of the extruding stem; and a hydraulic cylinder for opening and closing the seal block, wherein the seal block is opened and closed by swing-like motion in a direction perpendicular to the axial direction of the extruding stem, the seal block comes into contact with an outer surface of the ring-like protrusion and an outer surface of a fixed dummy block or the extruding stem at the same time through sealing members attached to a contact surfaces of the seal block pieces when the seal block is closed, and the seal block pieces are moved between a position where the seal block is closed and a backmost position where the seal block is opened by the rectilinear motion of a rod of the hydraulic cylinder.

According to a seventh aspect, on the basis of the sixth aspect, the seal block is provided with a vacuum deaerating hole for eliminating residual air in the container wherein the vacuum deaerating hole is connected to a vacuum pump through a pipe line.

According to an eighth aspect, on the basis of the sixth aspect, the fixed dummy block is provided with an internal cooler for cooling the fixed dummy block.

According to a ninth aspect, on the basis of the sixth aspect, the seal block is provided with a cooler for cooling the sealing member. According to a tenth aspect, on the basis of the sixth aspect, the ring-like protrusion is provided with a deaerating groove formed in an inner surface thereof at the extruding stem side, the deaerating groove being formed in a circular shape the inner diameter of which is larger than the outer diameter of the fixed dummy block fixed to an end of the extruding stem.

According to an eleventh aspect, on the basis of the sixth aspect, the seal block pieces are each structured to be separated into an inner seal block piece, positioned at an inner side of the seal block and having the sealing member, and an outer seal block piece, positioned outside the inner seal block piece to hold the inner seal block piece, wherein the inner seal block piece has a first coolant path formed radially and covered by a lid, a second coolant path between the inner seal block piece and the outer seal block piece, and gas outlets for spraying coolant to the sealing members and for blowing off sticks such as dusts and residues.

The extruder is provided with the ring-like protrusion, disposed on the end surface of the container at the extruding stem side, and rotational bases of the seal block pieces at the upper end surface of the container. The container is sealed by the seal block pieces, fixed to tips of swing arms extending from the rotational bases to allow the closing motion of the seal block in the direction perpendicular to the axial direction of the container. The ring-like protrusion is provided with the deaerating groove formed in the inner surface thereof at the extruding stem side. The deaerating groove is formed in a circular shape, the inner diameter of which is larger than the outer diameter of the fixed dummy block fixed to an end of the extruding stem so as to form a space between the inner surface of the ring-like protrusion and the outer surface of the fixed dummy block when the billet is loaded in the container by the extruding stem. Therefore, air trapped between the container and the billet is easily vacuumed, thereby significantly improving the yield of the end products without blister Moreover, the ring-like seal block is cooled while coolant passes through the coolant paths formed in the ring-like seal block. The ring-like seal block is provided with gas outlets for spaying the coolant to the sealing members and for blowing off sticks such as dusts and residues at the same time. The sealing members are cooled by the coolant spouted out from the gas outlets whenever the seal block is closed, thereby increasing the life of the sealing member. During closing the seal block, the gases spouted out from the gas outlets blow off aluminum residues, dusts and residues glued on the outer surface of the extruding stem or around the inner surface of the seal block, thereby keeping the higher sealing performance and performing the deaeration with higher degree of vacuum.

According to a twelfth aspect, an extruder comprises a container having a container liner into which a billet is loaded; a ring-like protrusion disposed on an end surface of the container at an extruding stem side; a ring-like seal block being opened and closed in a direction perpendicular to the axial direction of the extruding stem, wherein when the seal block is closed, the seal block comes into contact with an outer surface of the ring-like protrusion and an outer surface of a fixed dummy block or the extruding stem through a sealing member attached to contact surface of the seal block; and a cooler disposed in the seal block for cooling the sealing member. According to a thirteenth aspect, on the basis of the twelfth aspect, the seal block is provided with seal block pieces pivotally mounted for closing and opening the seal block, and the seal block pieces pivot so as to clamp the outer surface of the ring-like protrusion and the outer surface of the fixed dummy block or the extruding stem through the sealing members when the seal block is closed.

According to a fourteenth aspect, on the basis of the twelfth aspect, the extruder further comprises a guide ring and guide rods. The guide rods are disposed above and under the seal block, respectively. The guide rods can move linearly and sidewardly (horizontally), and the rods can slide on the guide ring. Two seal blocks are moved apart from and getting closer to each other by the guide rod and the cylinder.

According to a fifteenth aspect, on the basis of the twelfth or thirteenth aspect, the fixed dummy block is provided with an internal cooler for cooling the fixed dummy block.

According to a sixteenth aspect, on the basis of the twelfth aspect, the seal block is provided with a vacuum deaerating hole for eliminating residual air in the container wherein the vacuum deaerating hole is connected to a vacuum pump through a pipe line.

According to a seventeenth aspect, on the basis of the twelfth aspect, the ring-like seal block is provided with gas outlets inside thereof for spraying coolant to the sealing members and for blowing off sticks such as dusts and residues.

The fixed dummy block fixed to the working-side end of the extruding stem is cooled inside thereof before vacuuming air from the container. Air in the container is vacuumed before the billet is compressed between the extruding stem and the die, with the container being sealed by the seal block pieces by coming into close contact with the ring-like protrusion and the extruding stem at the same time. The seal block pieces are fixed to the tips of the swing arms extending from the rotating bases disposed on the upper end surface of the extruding stem side extruding stem side to allow the closing motion of the seal block in the direction perpendicular to the axial direction of the container. Therefore, air trapped between the container and the billet can be easily vacuumed, thereby significantly improving the yield of the end products without blister.

Moreover, the ring-like seal block is cooled while coolant passes through the coolant paths formed in the ring-like seal block. The ring-like seal block is provided with gas outlets for spaying the coolant to the sealing members and for blowing off sticks such as dusts and residues at the same time. The sealing members are cooled by the coolant spouted out from the gas outlets whenever the seal block is closed, thereby increasing the life of the sealing member. During closing the seal block, the gases spouted out from the gas outlets blow off aluminum residues, dusts and residues glued on the outer surface of the extruding stem or around the inner surface of the seal block, thereby keeping the higher sealing performance and performing the deaeration with higher degree of vacuum.

BRIEF DESCRIPTION OF THE DRAWINGS

FIG. 3 is an enlarged partial sectional plan view of Fig. a;

DESCRIPTION OF THE PREFERRED EMBODIMENTS

Hereinafter, a first embodiment of an extruder according to the present invention will be described with reference to the attached drawings.

Figure 1:
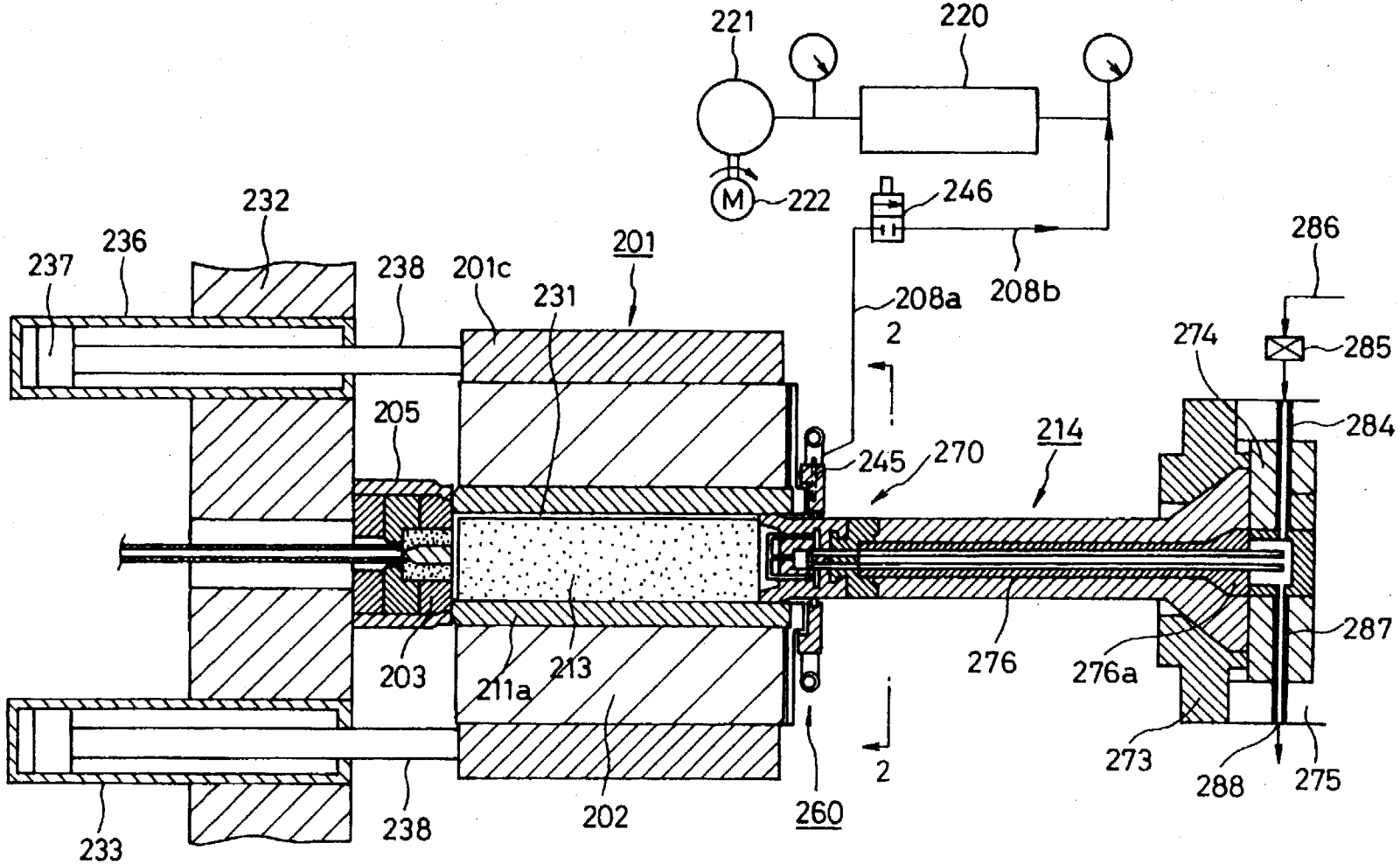
FIG. 1 is a system diagram of one preferred embodiment according to the present invention.
Figure 2:
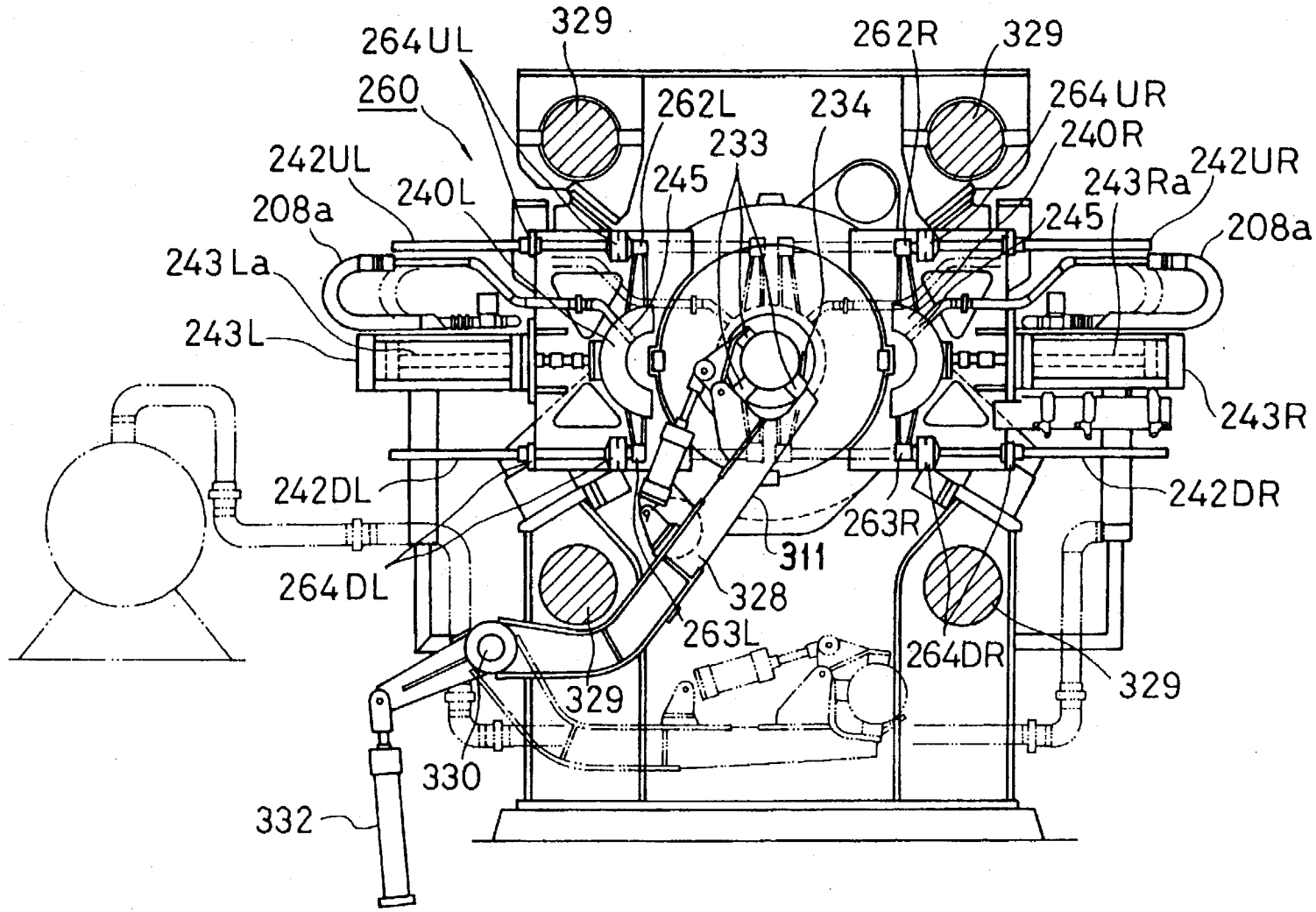
FIG. 2 is a perspective sectional view taken along a line 2—2 of FIG. 10.
Figure 3:
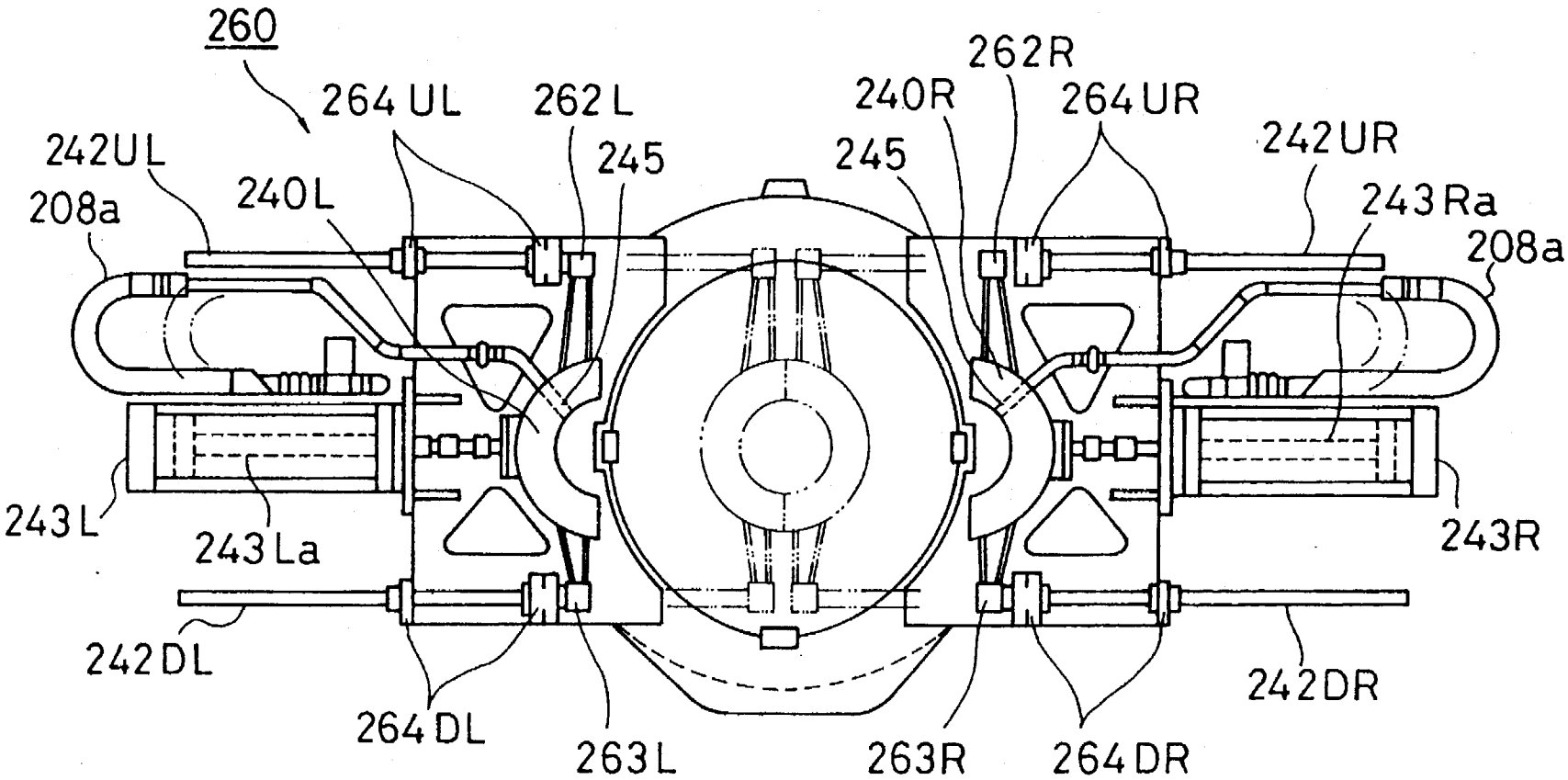
Figure 4:
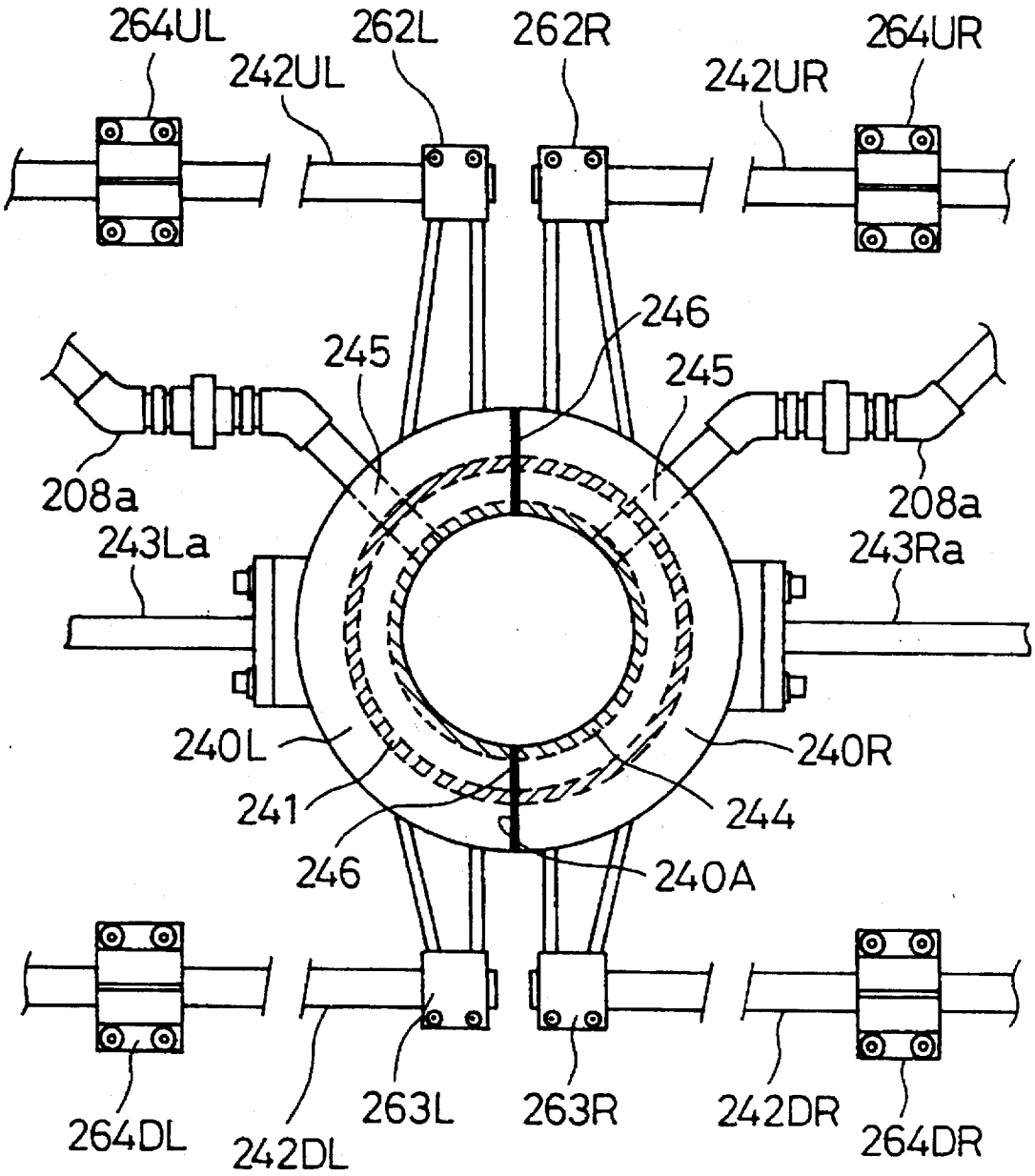
FIG. 4 is a front view of a seal block.
Figure 5A:
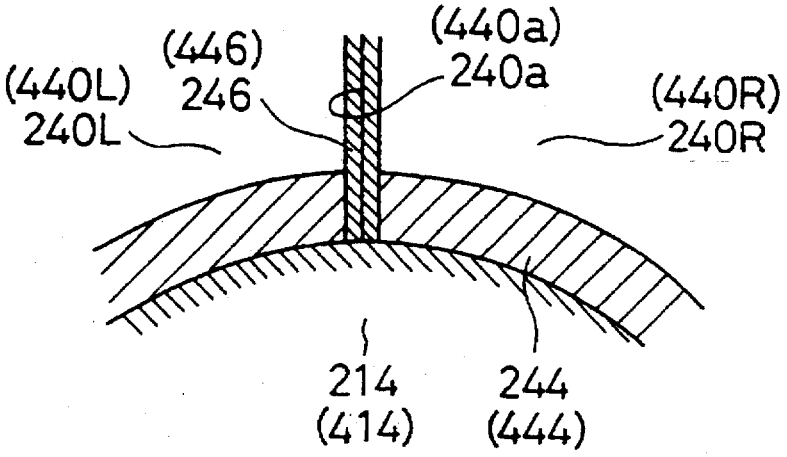
FIGS. 5A and 5B are views illustrating comparison between a case of a two-piece seal block in which both surfaces are glued with sealing materials, respectively, and a case without sealing material.
Figure 5B:
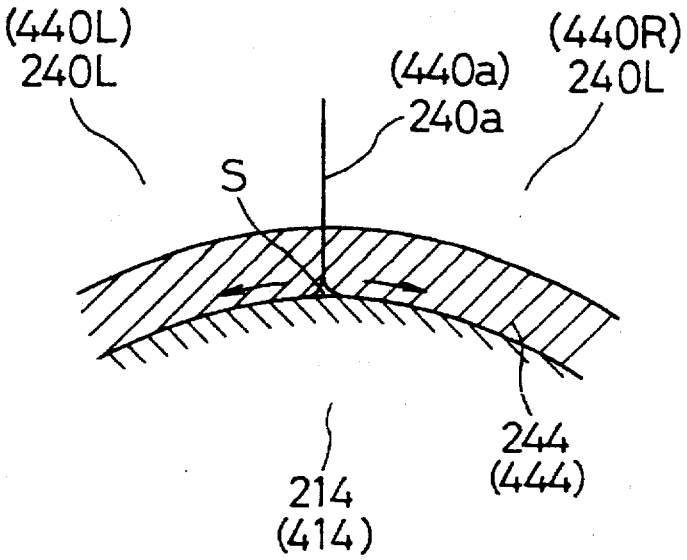
Figure 6A:
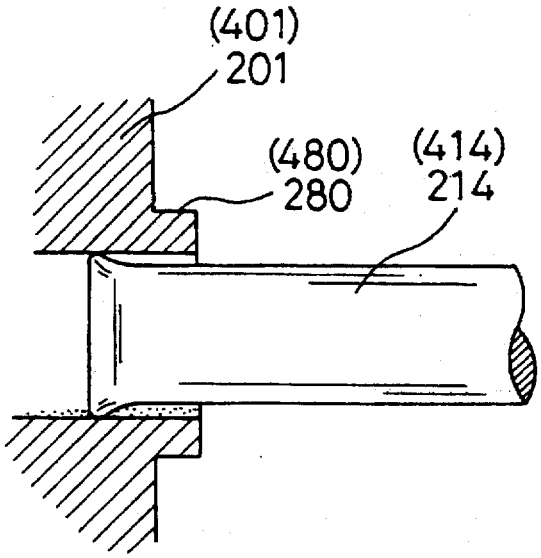
FIGS. 6A and 6B are views for explaining the conditions of scrapping off aluminum residues glued on the inner surface of a container.
Figure 6B:
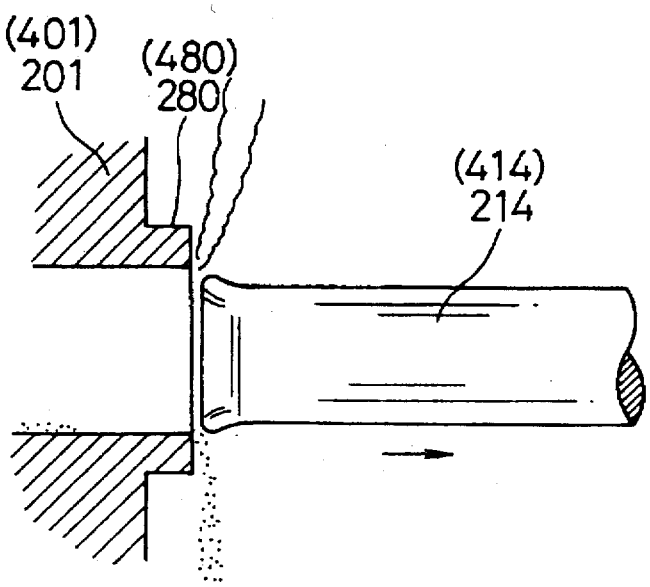
Figure 7:
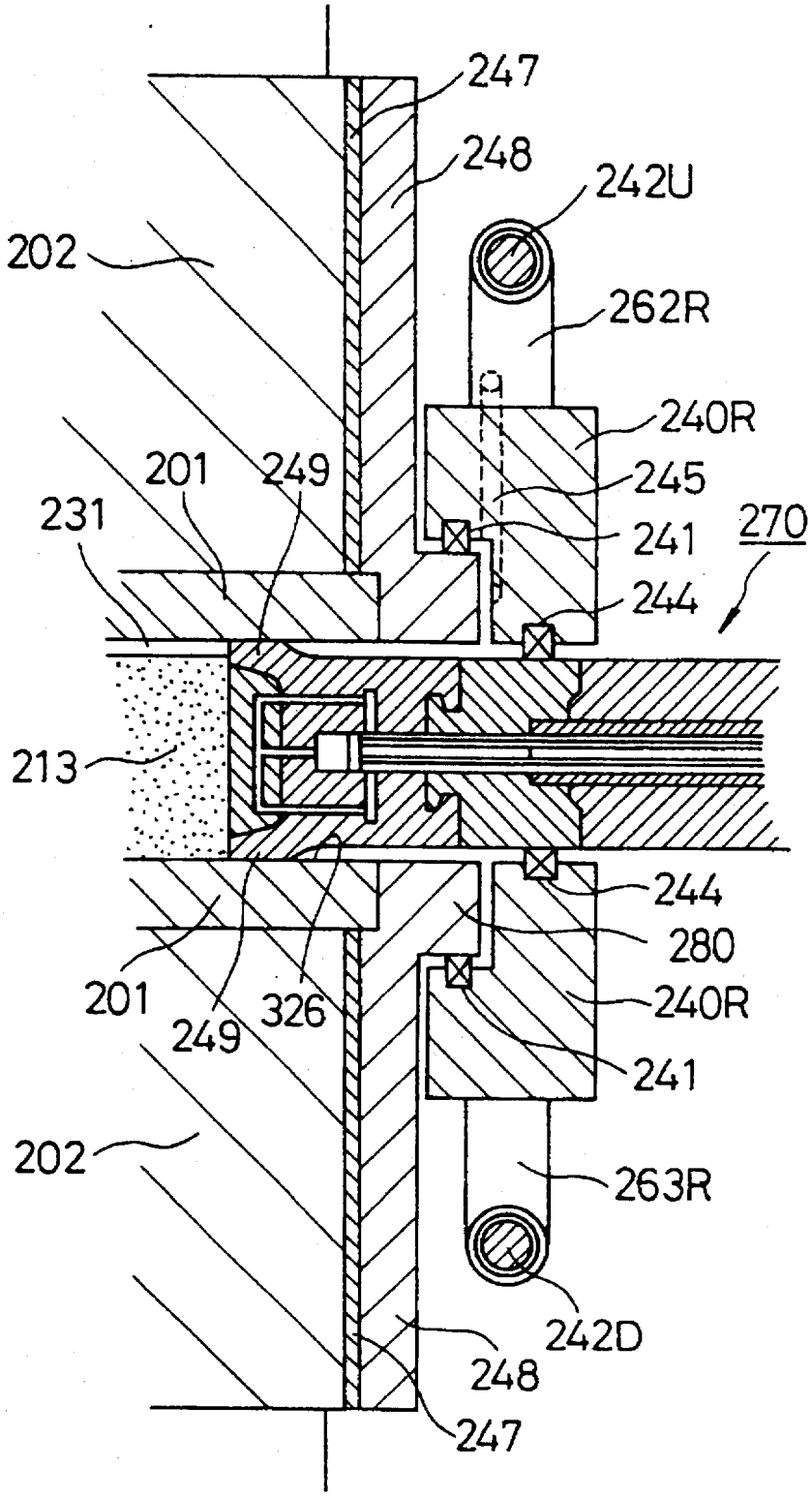
FIG. 7 is an enlarged sectional view of a seal block.

FIG. 1 is a system diagram of a first the second embodiment, FIG. 2 is a perspective view taken along a line 2—2 of FIG. 1, FIG. 3 is an enlarged partial sectional plan view of FIG. 2, FIG. 4 is an enlarged partial front view of a seal block, FIGS. 5A and 5B are views illustrating comparison between a case of a two-piece seal block in which both surfaces are glued with sealing materials, respectively, and a case without sealing material, FIGS. 6A and 6B are views for explaining the conditions of scrapping off aluminum residues glued on the inner surface of a container 201.

As shown in FIG. 1, an end platen 232 is provided with container cylinders 233 for allowing the sliding of a container 201 comprising a container liner 211*a*, a container tier 202 and a container holder 201*c*. Reference numeral 236 designates a cylinder tube which is a part of a cylinder body, 237 designates a piston, and 238 designates a piston rod.

Reference numeral 203 designates a die wherein an outer surface is slidably supported to the inner surface of a die ring 205. Reference numeral 231 designates a space, as a deaeration space to be deaerated, between the inner surface of the container and the outer surface of the billet 213.

An extruding stem 214 for extruding a billet 213 is provided with a fixed dummy block 270 at the tip end thereof which is possible to be in close contact with the inner surface of the container 201.

According to this embodiment, a vacuum aspirator 260 for aspirating residual air from the deaeration space 231 will be now described.

The vacuum aspirator 260 for deaerating the deaeration space 231 from the extruding stem 214 side in the container 201 is arranged on an end surface of the container 201 at the extruding stem 214 side as shown in FIG. 2 and FIG. 3. A ring-like seal block 240 of which front view is formed in a doughnut-like configuration is disposed on the end surface of the container 201 at the extruding stem 214 side. The seal block 240 is divided into seal block pieces 240R, 240L of which rear ends are fixed to tips of piston rods 243Ra, 243La, respectively. The piston rods 243Ra, 243La are slidably inserted into a pair of cylinders 243 (43R, 43L), respectively.

According to the sliding of the piston rods 243Ra, 243La, the seal block pieces 240R, 240L move to open or close the seal block 240 in a direction perpendicular to the axial direction of the container 201 along guide rods 242U (242UR, 242UL) and 242D (242DR, 242DL) which are disposed above and under the seal block 240, respectively.

The seal block pieces 240R, 240L are provided with a pair of upper guide legs 262 (262R, 262L) facing each other, respectively, disposed on the upper surfaces of portions near contact surfaces 240A thereof. The guide rod 242U (242UR, 242UL) are fixed to upper guide legs 262 (262R, 262L) and inserted into through rings 264 (264UR, 264UL) to allow the opening and closing of the seal block 240.

On the other hand, the seal block pieces 240R, 240L are also provided with a pair of lower guide legs 263 (263R, 263L) facing each other, respectively, disposed on the lower surfaces of portions near contact surfaces 240A thereof. The guide rod 242D (242DR, 242DL) are fixed to lower guide legs 263 (263R, 263L) and inserted into through rings 264 (264DR, 264DL) to allow the opening and closing of the seal block 240.

For preventing air infiltration between the contact surfaces 240A of the seal block pieces 240R 240L when the seal block 240 is closed as shown by chain lines in FIG. 4, the contact surfaces 240A are provided with sealing members 246 (sheet-like sealants) attached thereon.

For example, the sealing members 246 are preferably sponge-like sealants, having heat resistance and resiliency, made of silicon rubber or fluoro-rubber.

When the seal block 240 is closed, the seal block 240 comes into sealing contact with a protrusion 280 (described later) through the sealing members 246 attached to the contact surfaces 240A of the seal block pieces 240R, 240L and sealing members 241 disposed on the inner surfaces of the seal block pieces 240R, 240L and comes into sealing contact with an outer surface of the extruding stem 214 through sealing members 244.

Among the sealing members 241, 244, 246, the sealing members 241 and 244 are preferably made of a heat resistant and high deformable material, such as relatively hard string-like silicone rubber and string-like fluoro-rubber.

On the other hand, the sealing members 246 are preferably made of a soft sponge-like rubber by comparison with the sealing members 241, 244, for example, heat resistant sponge-like material such as sponge-like silicone rubber sheet and sponge-like fluoro-rubber sheet.

Particularly, when the seal block 240 is closed relative to the extruding stem 214, the sealing members 244 are pulled in a direction of arrow because of the friction between the outer surface of the extruding stem 214 and the sealing members 244 as shown in FIG. 5B, thereby causing a space S between ends of the contact surfaces 240A.

In case where the sealing members 246 of sponge-like soft rubber (each 3 mm in thickness) are attached to the contact surfaces 240A of the seal block pieces 240R and 240L as shown in FIG. 5A, the sealing members 246 are compressed when the seal block 240 is closed and free ends of the sealing members 246 are about to project toward the extruding stem, thereby preventing the aforementioned space S. This effect is common to the sealing members 241. That is, a space on an outer surface of the protrusion 280 can be prevented by the sealing member 241.

When the seal block pieces 240R, 240L return to the backmost positions thereof as shown by solid lines in FIG. 2, a billet loader 311 (described later) can move out and in with the billet 213 placed thereon.

The seal block pieces 240R, 240L are each provided with a deaerating hole 245 which is connected to an end of a flexible pipe line **208*a*, the other end of which is connected to a fixed pipe line 208*b* through an electromagnetic switch valve 246. The fixed pipe line 208*b* is connected to a vacuum tank 220**.

Reference numeral 247 designates an insulator for preventing heat for heating the container 201 from traveling to the vacuum aspirator 260. The insulator 247 is provided with a heat insulating plate 248 disposed the upper surface thereof. The seal block pieces 240R, 240L is movable between the backmost positions and the forward-most positions, where the seal block is closed, without friction with the insulating plate 248.

The insulating plate 248 is provided with the protrusion 280, a front surface of which is formed in a ring-like configuration in a position corresponding to a container liner **201*a*. When the seal block 240 is closed, the protrusion 280 comes in sealing contact with the seal block 240 through the sealing members 241. Reference numeral 221 designates a vacuum pump and 222** designates a motor.

Another one of main features of the present invention is that there is no cover plate nor guide rail for the close motion of the seal block 240. This is because the seal block 240 is opened with the guide rods 242U, 242D being guided by the through rings 264 (264UR, 264UL, 264DR, 264DL).

The above structure facilitates the exchange of the container tire 202 and the container liner **211*a* and does not deteriorate the sealing performance because in case of scrapping off aluminum residues glued on the inner surface of a container liner 211*a* by the outer surface of the fixed dummy block 270 when the extruding stem 214 returns to the original position after extruding the billet 213, the scrapped aluminum residues just fall down from the edge of the inner surface of the protrusion 280 as shown in FIG. 6A and FIG. 6B, not enter into a groove of the guide plate as the prior art which causes hitches to the close motion of the seal block 240**.

A billet loader 311 comprises a No. 1 billet loader and a No. 2 billet loader for supplying the billet 213 as an extrusion material to a billet loading opening 326 by clamping the billet 213, sent by a billet carrier (not shown) disposed at either side of the extruder, one by one, and lifting the billet 213 to the level of the billet loading opening 326.

The No. 1 billet loader and the No. 2 billet loader have the same structure.

The billet 213 is supplied below the container 201 by the billet carrier (not shown) one by one and then carried to the billet loading opening 326 with the billet 213 being clamped by the billet loader 311. Therefore, the billet loader 311 is disposed to face the billet carrier and is provided with a swing arm 328 which is pivotable along a plane perpendicular to the extruding axis of the extruder.

One end of the swing arm 328 is pivotally fixed to a central shaft 330 disposed outside a lower tight rod 329 of the extruder. The swing arm 328 is bent in a V-like shape with a high angle to prevent interference with the tight rod 329 during swinging and extends from a position below the lower tight rod 329 toward an upper portion of the container 201. The other end of the swing arm 328 travels from the board (not shown) of the billet carrier to the billet loading opening 326 and vice versa by the pivotal movement of the swing arm 328.

The swing arm 328 is connected to a hydraulic cylinder 332 which drives the swing arm 328 to pivot by its rectilinear motion.

The swing arm 328 is provided with a billet holder 233 for clamping the billet 213 placed on the other end thereof.

The billet holder 234 is provided with plates 334 for supporting the bottom of the billet 213 in a loading position.

Figure 8:
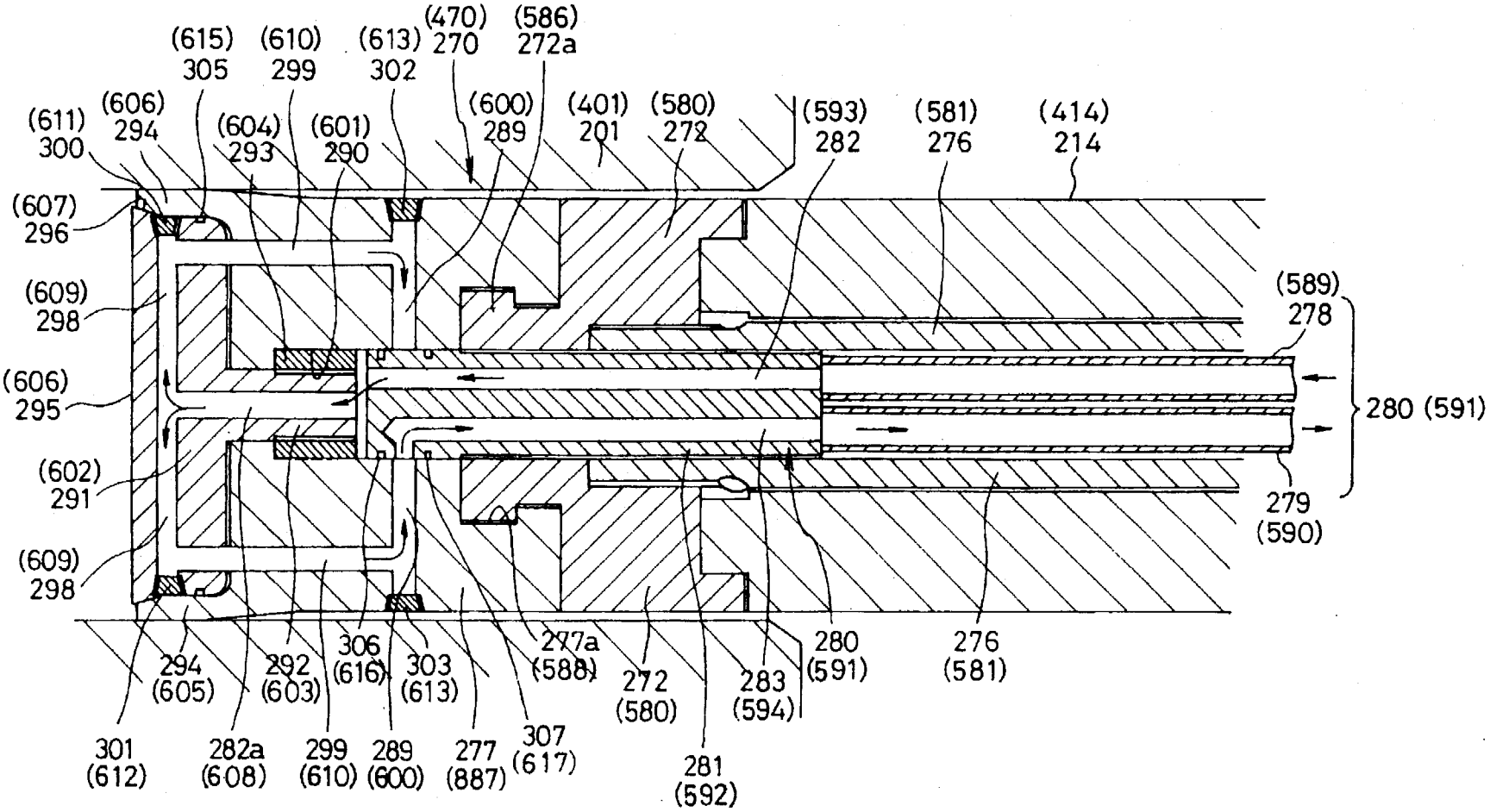
FIG. 8 is a sectional view of an extruding stem having an internal cooler.

As for the structure of the extruding stem 214, there are two cases: where the fixed dummy block 270 and the extruding stem 214 are connected through a bayonet block 272 as shown in FIG. 8 (hereinafter referred as "bayonet connection") and where the fixed dummy block 270 is directly connected to the extruding stem 214 by screwing.

First, the case of bayonet connection will be described as a typical structure.

In FIG. 8, reference numeral 201 designates the container, 214 designates the extruding stem, 270 designates the fixed dummy block of a fixed type which is fixed to the front surface of the extruding stem 214 and slidably disposed in the container 201. The rear end of the extruding stem 214 is fixed to a cross head 275 through a stem holder 273 and a pressure ring 274 as shown in FIG. 1.

The bayonet block 272 is disposed on the front surface of the extruding stem 214. A distal end of a connection rod 276 is screwed into the rear half of the bayonet block 272 so that the connection rod 276 is attached to the bayonet block 272. The connection rod 276 has a large-diameter portion 276*a* at the rear end thereof as shown in FIG. 1. The large-diameter portion 276*a* is fixed to a hole formed in the rear end portion of the extruding stem 214 so that tapered surfaces therebetween are engaged each other.

The front half of the bayonet block 272 has a structure of a bayonet type and is provided with, for example, three protrusions 272*a* disposed at equal spaces.

On the other hand, a dummy boss 277 is provided with concavities 277*a* disposed at equal spaces to engage the protrusions 272*a*. Installing the dummy boss 277 to the bayonet block 272 is securely and quickly accomplished by engaging the protrusion 272*a* of the bayonet block 272 with the concavities 277*a* of the dummy boss 277 and rotating the dummy boss 277 about 60 degree.

The connection rod 276 is provided with a through hole extending in the axial direction, in which a feed water pipe 278 and a drain pipe 279 are disposed. The feed water pipe 278 and the drain pipe 279 constitute a cooling pipe 280. Each one end of the feed water pipe 278 and the drain pipe 279 is secured to each of holes 282, 283 of a cooling pipe end block 281 by welding and each of the other ends extends to the inside of the pressure ring 274.

The end of the feed water pipe 278 is connected to a cooling water pump (not shown) through a path 284 of a pipe in the pressure ring 274, a valve 285, and a pipe line 286. The end of the drain pipe 279 is connected to a drain port 288 through a path 287 of a pipe in the pressure ring 274. There is a slight space between the inner surface of the extruding stem 214 and the outer surface of the connection rod 276 to keep the flexibility of the axis of the connection rod 276. There is also slight spaces between the inner surface of the connection rod 276 and the outer surfaces of the feed water pipe 278 and the drain pipe 279 not to directly cool the connection rod 276. Additionally, there is also a slight space between the inner surface of the connection rod 276 and the cooling pipe end block 281 to keep the flexibility of the axis of the connection rod 276.

In this case, since the feed water pipe 278 and the drain pipe 279 are inserted into the through hole formed in the connection rod 276, the connection rod 276 is not directly cooled and the temperature difference between the excruding stem 214 and the connection rod 276 is therefore small so as not to impair the flexibility of the axis of the fixed dummy block 270.

The hole 282 extends over the cooling pipe end block 281. The front end of the hole 283 is connected to a hole 289 allowing the outward flow through a cooling pipe end block 281.

The dummy boss 277 is provided with a central through hole 290 into which a small cylindrical protrusion 292 formed in a middle portion of a core block 291 is inserted. The small cylindrical protrusion 292 comes in tight contact with the dummy boss 277 by engaging a connection nut 293 to a screw thread formed in the protrusion 292 from the rear side of the dummy boss 277 and screwing up the connection nut 293.

The dummy boss 277 is provided with a cylindrical outer ring 294 integrally fixed to the front end periphery thereof. There is a space between the rear end surface of the core block 291 and the front end surface of the dummy boss 277 to correspond to the differential between the distal end of the outer ring 294 and an outside surface 295 of the core block 291. Therefore, as the core block 291 is pressed backward during extrusion, the rear end surface of the core block 291 comes into contact with the front end surface of the dummy boss 277. The outer ring 294 is stretched and comes into contact with the inner surface of the container to prevent the billet 213 to flow toward the extruding stem 214 of the fixed dummy block 270.

The core block 291, the outer ring 294, and the dummy boss 277 constitute the fixed dummy block 270. Therefore, the outer surface of a front portion of the outer ring 294 is designed to substantially come into contact with the inner surface of the container 201. The core block 291 has a tapered portion 296, the front portion of which is wider than the rear portion, to be in tight contact with a tapered portion disposed on the front inner surface of the outer ring 294. The center axial portion of the core block 291 and the protrusion 292 is provided with a path 282*a* which cooling water supplied from the feed water pipe 278 passes through. The distal end of the path 282*a* extends to a portion near the outside surface 295 of the core block 291.

As shown in FIG. 8, the path 282*a* is provided with a plurality of cooling paths 298 (eight cooling paths in this embodiment) extending radially from the end of the path 282*a* to the outer ring 294.

Paths 299 extend in the axial direction from the outer ends of the paths 298 to be disposed near the outer portion of the extruding stem 214 over the dummy boss 277 and the core block 291 and is connected to the hole 289 of the cooling pipe 280. Reference numerals 300, 301, 302, 303 designate plugs and 305, 306, 307 designate heat resistant O-rings, respectively.

The above mechanism for cooling the fixed dummy block may be deleted.

Hereinafter, the operation of the extruder mentioned above will be described.

First, the piston 237 is moved in the left direction of FIG. 1 by supplying pressure oil to a rod side of the container cylinder 233 to advance the container 201, which is now spaced apart from the die 203, so that the container 201 comes into contact with the die 203.

After that, the billet loader 311, on which the billet 213 is now placed, rises up. The billet 213 is pressed into the container 201 according to the advance of the extruding stem 214 and moves toward the die 203.

At this point, the deaeration space 231 among the container 201, the die 203, and the billet 213 includes air. When the billet 213 is pressed into the container 201 according to the advance of the extruding stem 214 and a large-diameter end portion 249 of the fixed dummy block 270 passes through the seal block 240, the seal block 240 is closed. The seal block 240 in the closed state is shown by two-dot chain lines in FIG. 10.

When the billet 213 is pressed to a position 10–20 mm before the die 203 as shown in FIG. 1, the electromagnetic switch valve 246 is actuated to allow communication of air between the container 201 and the vacuum tank 220 so that residual air in the container 201 is vacuumed.

The inside of the vacuum tank 220 is already in a vacuumed state of less than 5 torr by the vacuum pump 221.

Once the electromagnetic switch valve 246 is actuated, the residual air in the container 201 is vacuumed by the vacuum tank 220. After 0.2–0.5 seconds, the inside of the container 201 becomes 5–30 torr. Air at the extruding stem 214 side passes through the deaerating holes 245 formed in the seal block 240 and is vacuumed into the vacuum tank 220 through the pipe line 208*a*, the electromagnetic switch valve 246 disposed above the pipe line 208*a*, and the pipe line 208*b*. Therefore, air is quickly and sufficiently exhausted from the deaerating holes 245 of the seal block 240. After that, the extruding stem 214 further moves forward so that the distal end of the billet 213 comes into contact with the die 203, thereby making the hydraulic pressure in a side cylinder higher. When the hydraulic pressure becomes to a predetermined value, a main cylinder (not shown) replaces the side cylinder to supply hydraulic pressure. Thus, the upsetting is completed.

Before starting the upsetting, a coolant supplying device not shown is actuated to introduce the coolant such as cooling water to the cooling paths 298 so as to cool the fixed dummy block 270 form the inside thereof. It should be noted that the cooling water is hard to vapor in the cooling paths 298 and the cooling paths 298 are simply structured. The cooling water is entered from the rear side of the extruding stem 214 to pass through the feed water pipe 278 in the connection rod 276 of the extruding stem 214, the path 282*a*, the cooling paths 298, the path 299, and the hole 289 and is then drained from the rear side of the extruding stem 214 through the drain pipe 279.

According to the present invention, the cooling paths 298 are radially disposed near the outside surface 295 from the central portion of the core block 291, thereby lowering the temperature of the outside surface 295 of the fixed dummy block 270 during the upsetting to 200°–230° C. by the cooling water.

Therefore, this prevents the thermal expansion of the large-diameter end portion 249 of the fix dummy block 270 during the extrusion. Since a space between the inner surface of the container 201 and the outer surface of the large-diameter end portion 249 of the fixed dummy block 270 are kept whenever the deaeration is performed from the extruding stem 214 side, the deaeration space 231 of the container 201 is sufficiently deaerated.

When starting the upsetting, a rear end portion of the billet 213 being in contact with the fixed dummy block 270 are cooled.

As the upsetting is started, a peripheral end portion of the billet 213 at the extruding stem 214 side is expanded to come in tight contact with the inner surface of the container 201.

When the upsetting is performed, the rear end portion of the billet 213 is cooled so that the fluidity thereof is decreased and the frictional resistance between the front end surface of the fixed dummy block 270 and the rear end portion of the billet 213 is therefore increased, thereby preventing the surface of the rear end portion of the billet 213 from flowing inside thereof. Therefore, air of small volume existing on the surface of the rear end portion is prevented from being trapped into the rear end portion of the billet 213. The air sealing at the fixed dummy block 270 side is accomplished only by the expansion of the rear end portion of the billet 213.

As described above, the air causing blisters can be sufficiently eliminated by preventing the trapping of the surface of the rear end portion of the billet 213 and the air existing there by cooling the fixed dummy block 270, and by deaerating the space between the surface of the billet 213 and the inner surface of the container 201.

Particularly, in this embodiment, as the temperature of the front end surface of the fixed dummy block 270 is lowered to 250° C. or less, air is prevented from being trapped into the rear end portion of the billet 213 due to the decreased fluidity of the rear end portion of the billet 213, thereby preventing occurrence of blister in an end product. The technical knowledge as described above was obtained by various examinations.

After that, the extruding stem 214 continuously moves forward to squeeze the billet 213.

Soon after that, the extrusion is started to extrude an end product from the die 203.

Upon completion of the upsetting for the billet, after a suitable period from starting the extrusion by the advance of the extruding stem 214 (for example, at a point where ⅓ length of the initial length of the billet 213 is extruded), the deaeration is stopped and the seal block 240 is opened, that is, the seal block pieces 240R, 240L return to the backmost positions thereof. After that, the extrusion by the extruding stem 214 is still performed. Upon completion of the extrusion, the extruding stem 214 is returned to start a next extrusion cycle.

As apparent also from the above description, according to the first embodiment, (1) the two-piece seal block disposed on the end surface, at the extruding stem side, of the cylindrical container is closed in a direction perpendicular to the axial direction of the extruding stem, thereby making the sealing performance higher and providing sufficient deaeration, without making the whole length of the extruder longer;

(2) the sealing is performed by the two-piece seal block in a short time, thereby reducing the idle time;

(3) the two-piece seal block is spaced apart from the ring-like protrusion and the extruding stem just before the two-piece seal block is closed, thereby making the lives of the sealing members longer;

(4) in case of scrapping off aluminum residues by the outer surface of the fixed dummy block when the extruding stem is returned to the original position after extruding the billet, the scrapped aluminum residues just fall down out of the container, not enter into a groove of the guide plate as the prior arts, thereby keeping the higher sealing performance;

(5) this structure does not necessitate the verp cycle as the prior art, thereby reducing the idle time; and (6) metal flow in the billet during the extrusion is prevented, thereby stably extruding the material without blister and further significantly improving the yield of the end products.

Hereinafter, a second embodiment of the extruder according to the present invention will be described with reference to the attached drawings.

Figure 10:
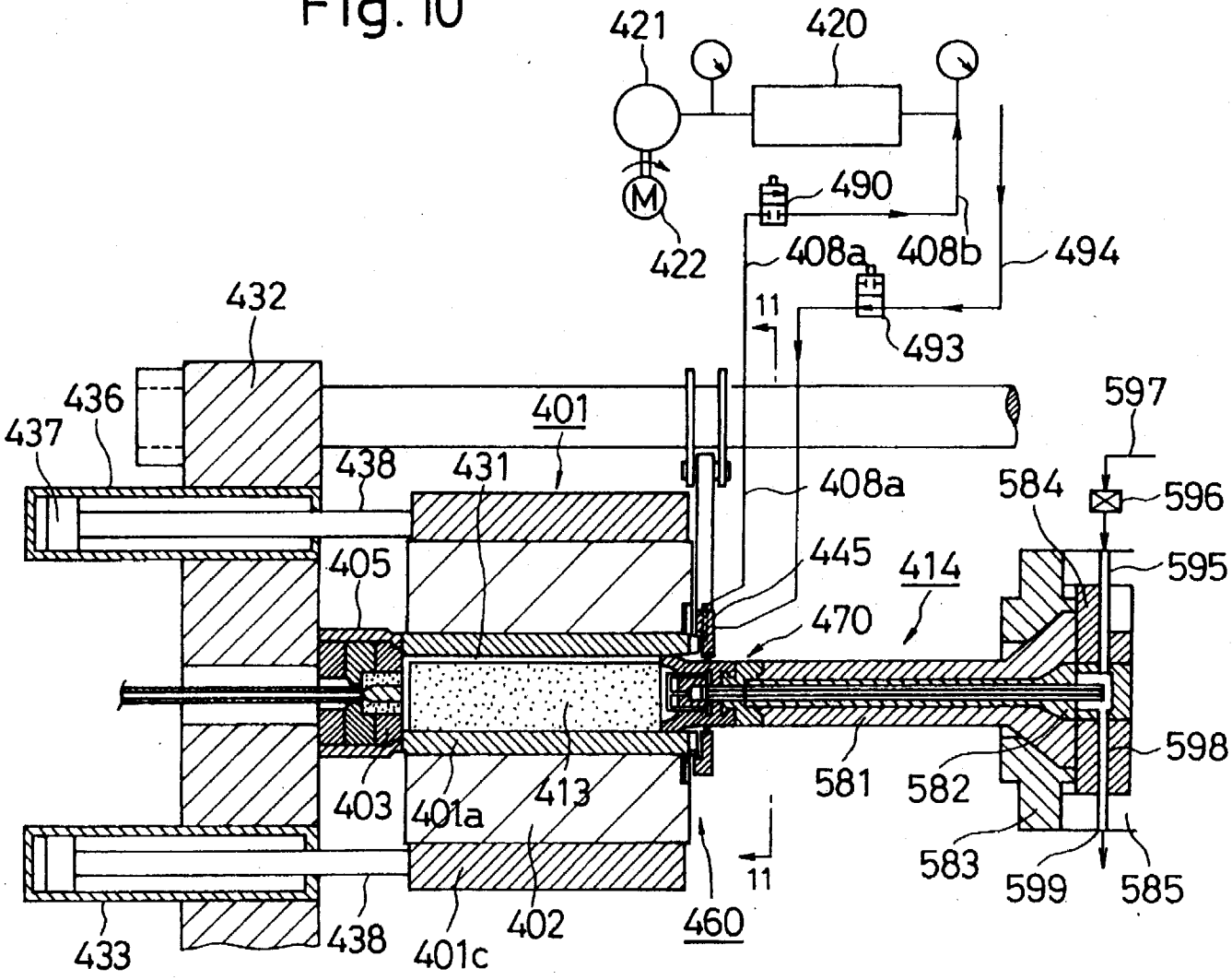
FIG. 10 is a system diagram of an extruder provided with a preferred deaerator according to the present invention.
Figure 11:
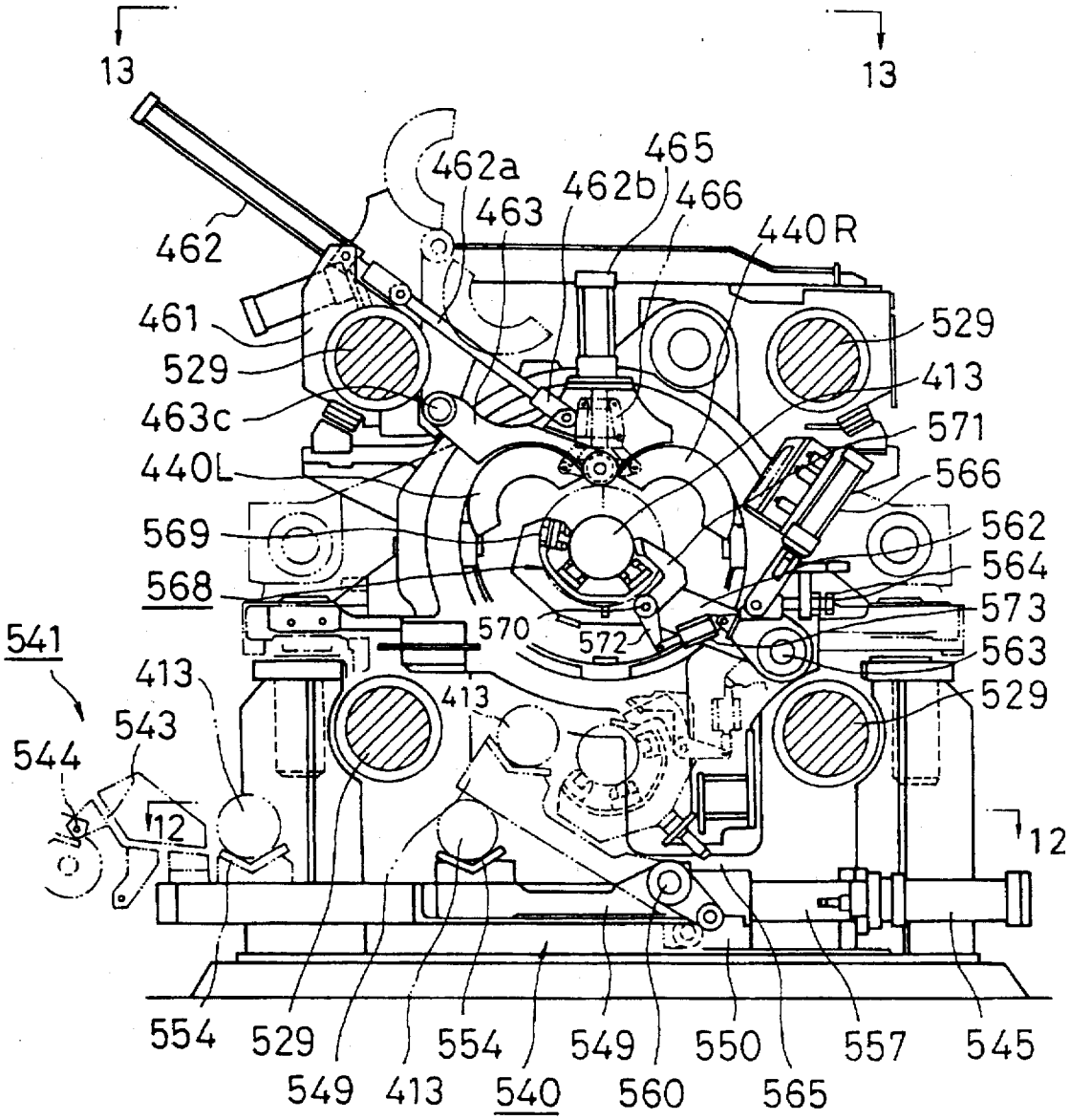
FIG. 11 is a front view taken along a line 11—11 of FIG. 10.
Figure 12:
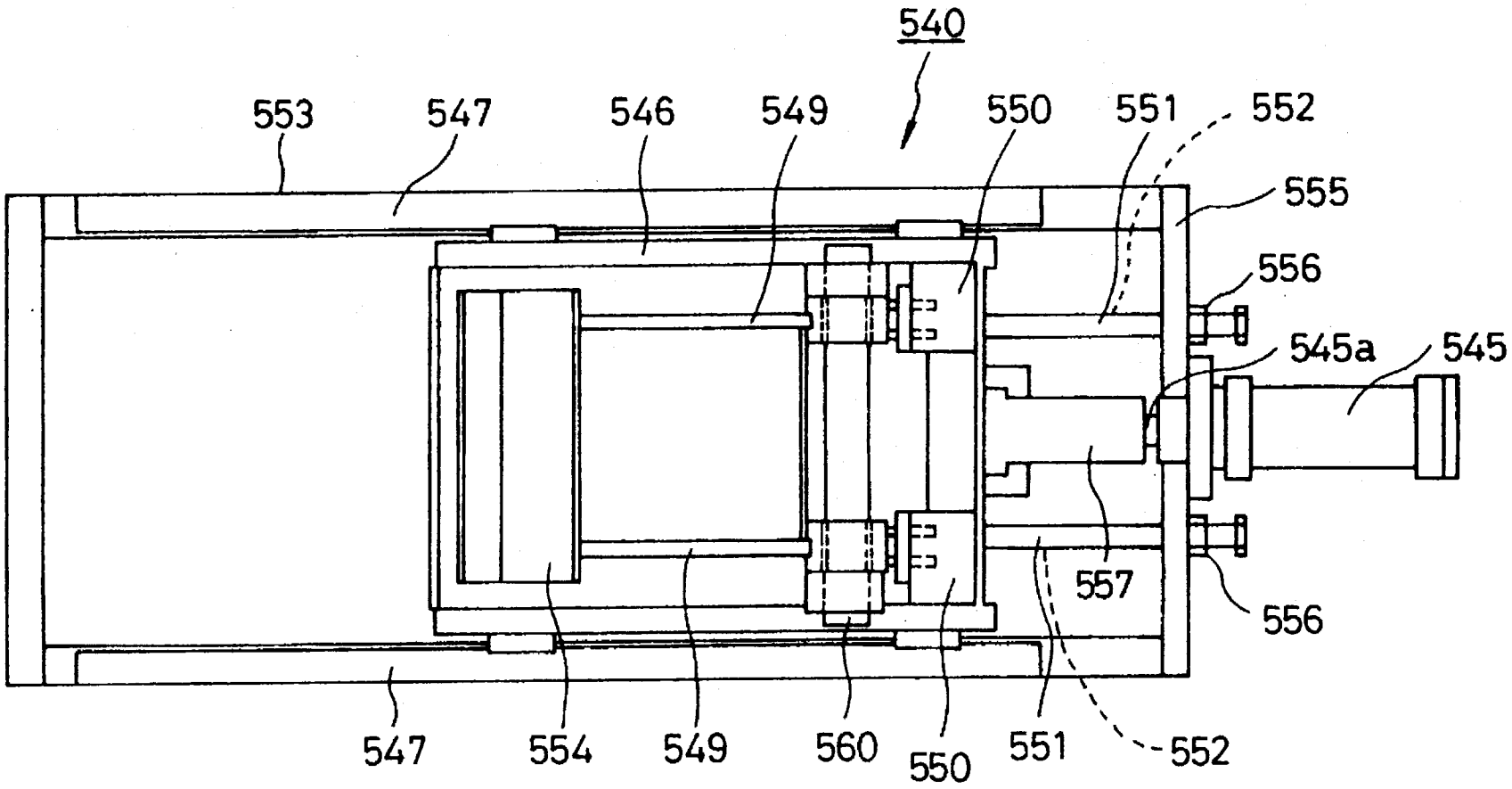
FIG. 12 is a front view taken along a line 12—12 of FIG. 11.
Figure 13:
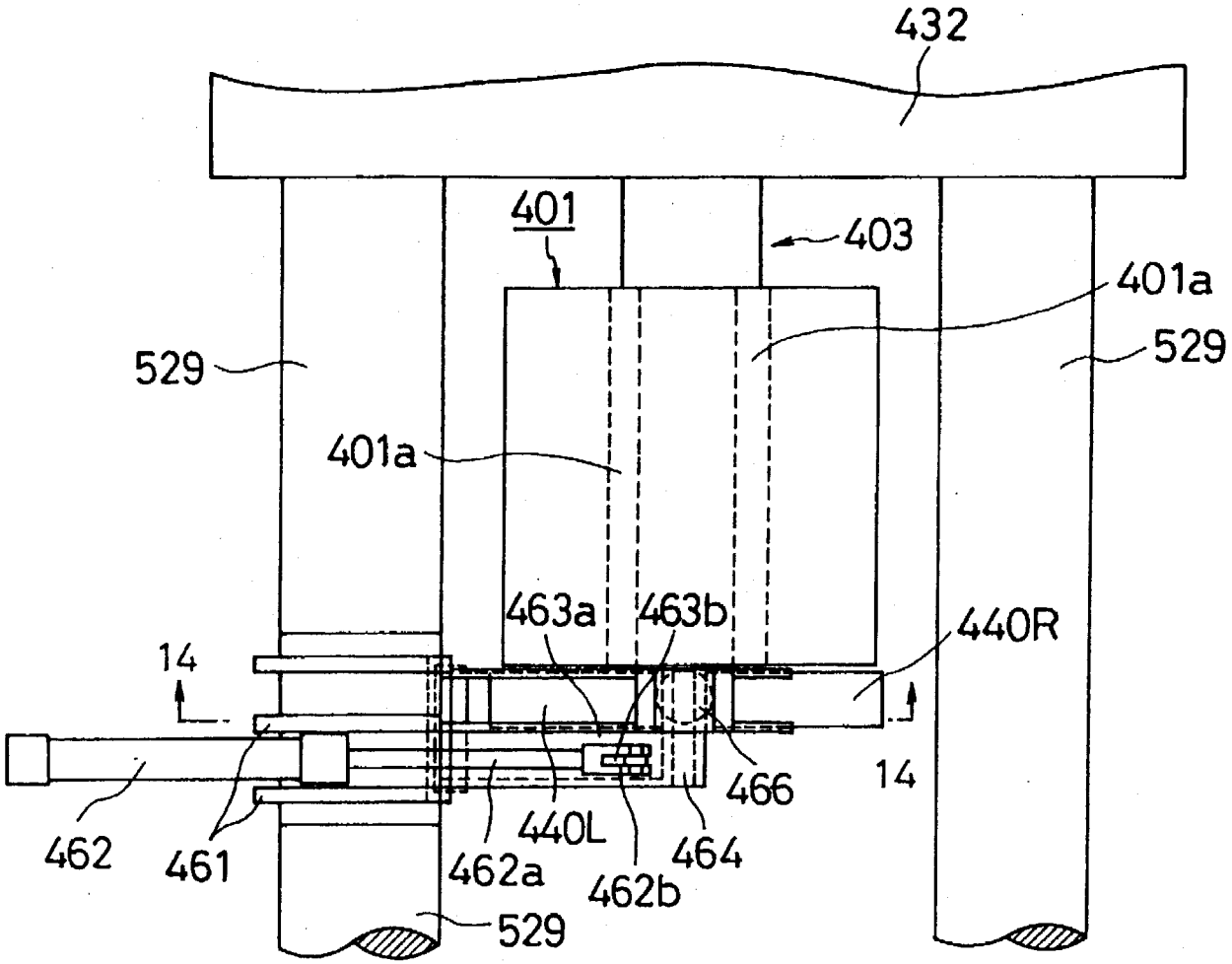
FIG. 13 is a plan view taken along a line 13—13 of FIG. 11.
Figure 14:
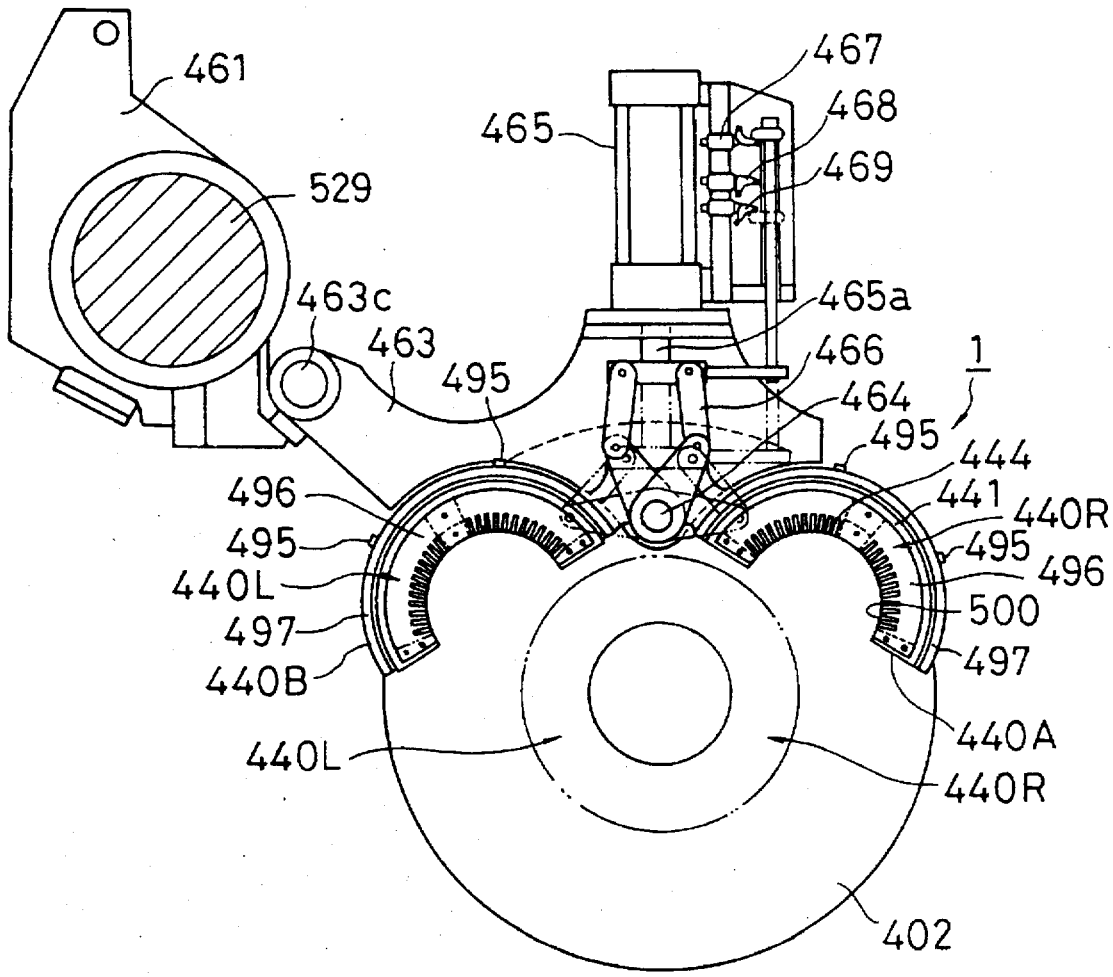
FIG. 14 is a front view taken along a line 14—14 of FIG. 13.
Figure 15:
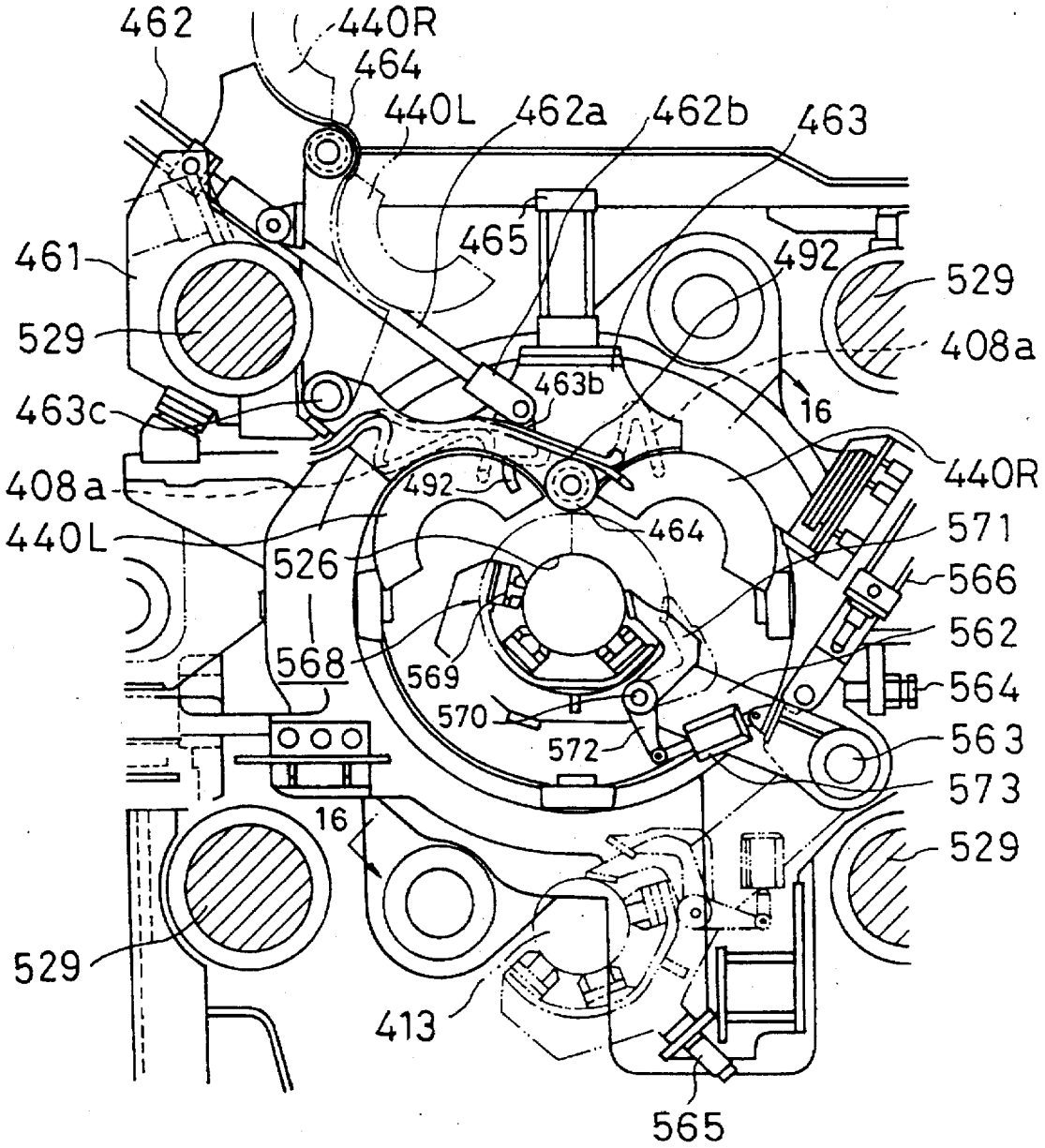
FIG. 15 is an enlarged partial sectional plan view of a seal block.
Figure 16:
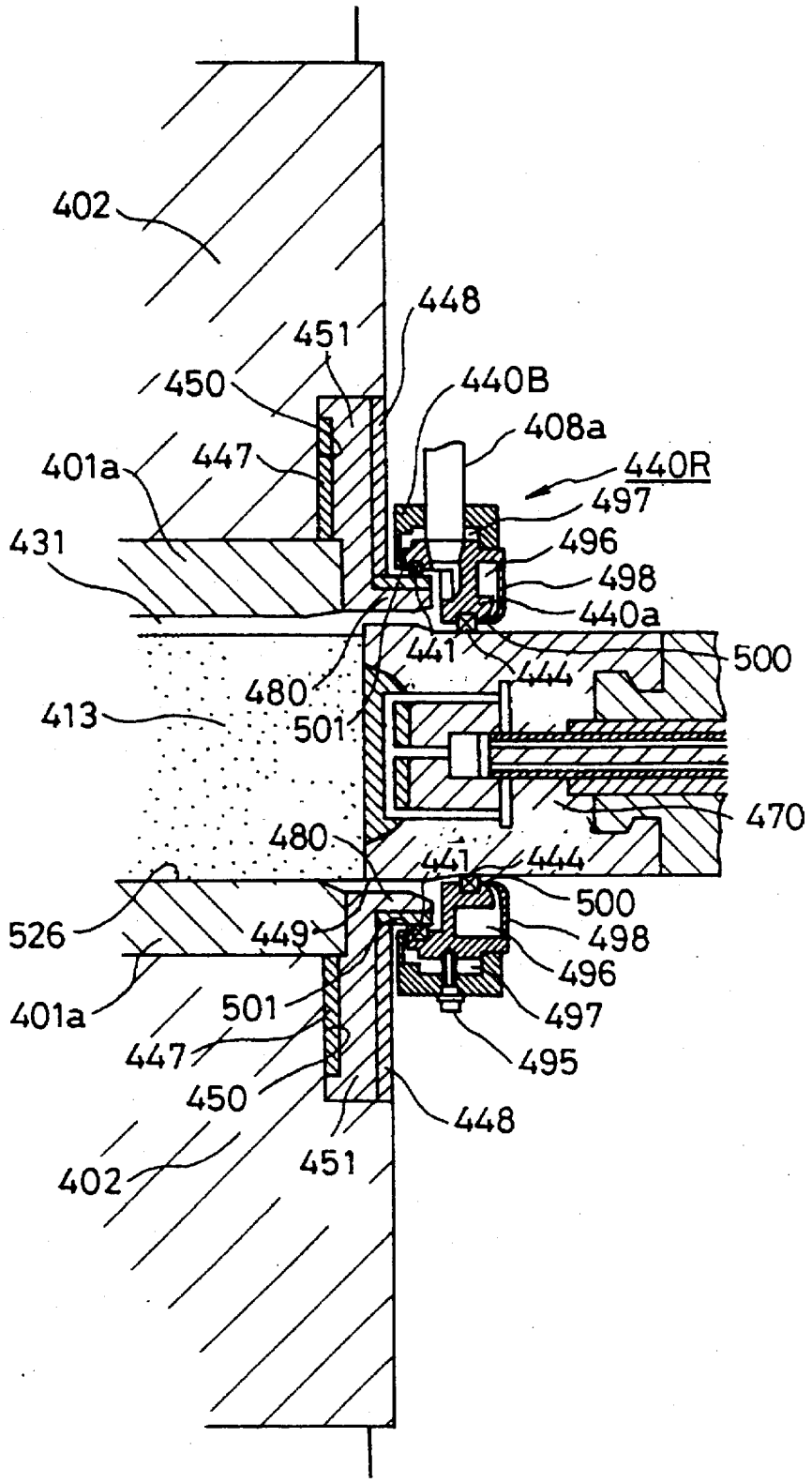
FIG. 16 is a sectional view taken along a line 16—16 of FIG. 15.
Figure 17:
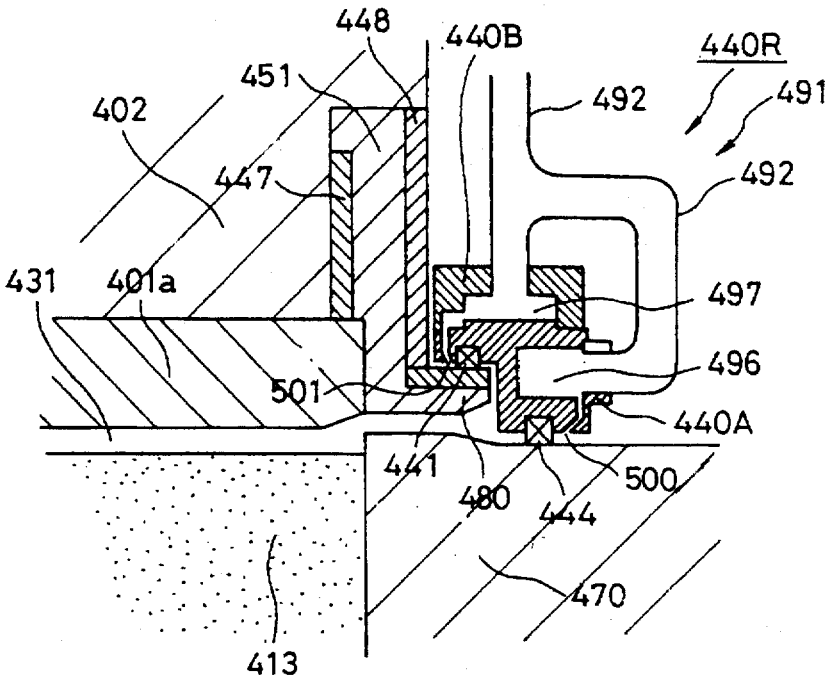
FIG. 17 is an enlarged partial sectional plan view of a cooler mounted on the seal block.
Figure 18:
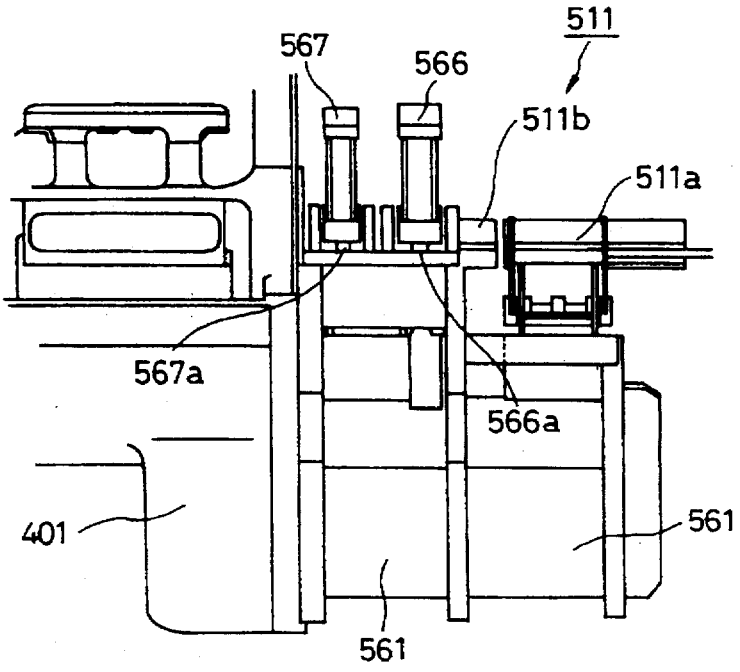
FIG. 18 is a front view of a billet loader.
Figure 19:
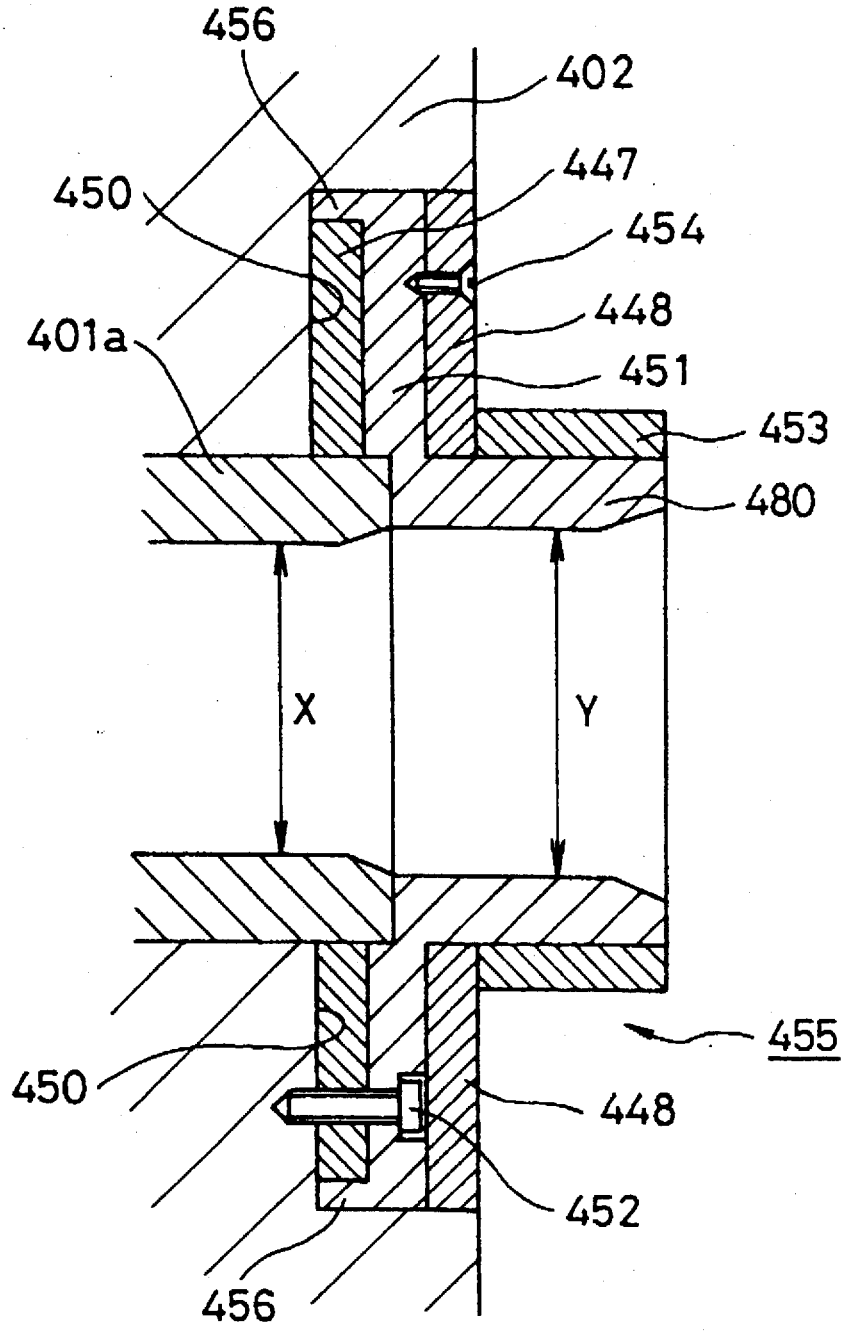
FIG. 19 is a partially sectional view of a protrusion.

FIG. 10 is a system diagram of an extruder provided with a preferred deaerator according to the present invention, FIG. 11 is a front view taken along a line 11—11 of FIG. 10, FIG. 12 is a front view taken along a line 12—12 of FIG. 11, FIG. 13 is a plan view taken along a line 13—13 of FIG. 11, FIG. 14 is a front view taken along a line 14—14 of FIG. 13, FIG. 15 is an enlarged partial sectional plan view of a seal block, FIG. 16 is a sectional view taken along a line 16—16 of FIG. 15, FIG. 17 is an enlarged partial sectional plan view of a cooler mounted on the seal block, FIG. 18 is a front view of a billet loader, FIG. 19 is a partially sectional view of a protrusion, FIGS. 20A, 20B, 20C and 20D are enlarged sectional views illustrating various configurations of the inside of the protrusion, FIGS. 21A through 21E are views for explaining the mounting structure of a heat insulating seal block, and FIGS. 22A, 22B and FIGS. 23A, 23B are views illustrating the opening and closing of the seal block and the conditions of spraying coolant.

Figure 9:
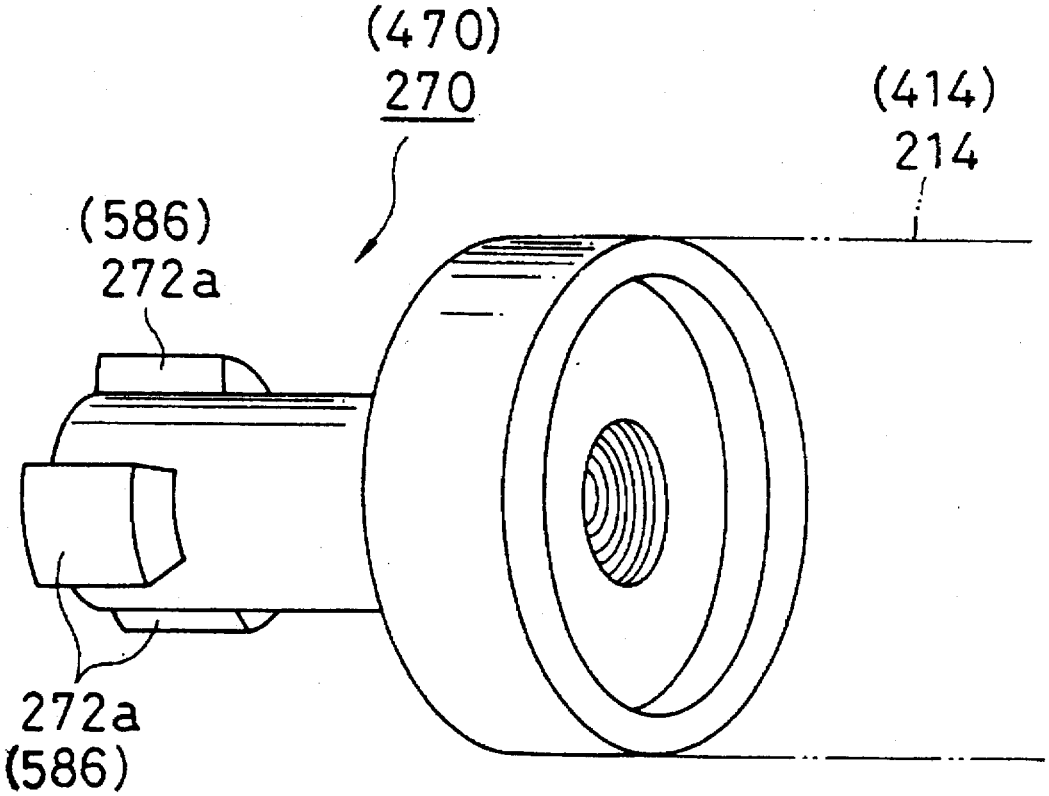
FIG. 9 is a perspective view of a bayonet block.

Views illustrating comparison between a case of a two-piece seal block, both surfaces of which are glued with sealing materials, respectively, and a case without a sealing material are the same as FIGS. 5A and 5B. The conditions of scrapping off aluminum residues glued on the inner surface of a container are the same as shown in FIGS. 6A and 6B. The section of an extruding stem is the same as shown in FIG. 8. The perspective view of a bayonet block is the same as FIG. 9.

As shown in FIG. 10, an end platen 432 is provided with container cylinders 433 for allowing the sliding of a container 401 comprising a container liner 401*a*, a container tier 402 and a container holder 401*c*. Reference numeral 436 designates a cylinder tube which is a part of a cylinder body, 437 designates a piston, and 438 designates a piston rod.

Reference numeral 403 designates a die, outer surface of which is slidably supported to the inner surface of a die ring 405. Reference numeral 431 designates a space, as a deaeration space to be deaerated, between the inner surface of the container and the outer surface of the billet 413. An extruding stem 414 for extruding a billet 413 is provided with a fixed dummy block 470 at the tip end thereof which is possible to be in close contact with the inner surface of the container 401.

According to this embodiment, a vacuum aspirator 460 for aspirating residual air from the deaeration space 431 will be now described.

The vacuum aspirator 460 for deaerating the deaeration space 431 from the extruding stem 414 side in the container 401 is arranged on an end surface of the container 401 at the extruding stem 414 side as shown in FIG. 10 and FIG. 11. A pair of brackets 461 is mounted to a tight rod 529 which is, for example, the left one of two upper tight rods 529 as shown in FIG. 11 and FIG. 13 and a movable hydraulic cylinder 462 is pivotally supported on an upper portion between the brackets 461. The movable hydraulic cylinder 461 is provided with a piston rod 462*a*, an end of which is fixed to a clevis 462*b*. The clevis 462*b* is pivotally supported to a triangle bracket 463*b* fixed to a L-like bracket 463*a* extending to the upper end of a pivotable arm 463 so that the two-piece seal block 440 can be moved to a position shown by two-dot chain lines of FIG. 11 by drawing the piston rod 462*a*.

On the other hand, one end of the pivotable arm 463 for the two-piece seal block is pivotally supported to a lower portion of the bracket 461 by a supporting shaft 463*c* and the other end supports the two-piece seal block 440, of which front view is formed in a doughnut-like configuration, allowing the opening and closing of the two-piece seal block 440 through a supporting shaft 464. At the upper side of the two-piece seal block 440, a seal block closing hydraulic cylinder 465 is connected to the two-piece seal block 440 through a link mechanism 466.

The link mechanism 466 opens or closes according to the expansion of the piston rod 465*a* of the seal block closing hydraulic cylinder 465. That is, the two-piece seal block 440 is opened when the piston rod 465*a* is drawn (shown by solid lines in FIG. 14), while the two-piece seal block 440 is closed when the piston rod 465 is stretched (shown by two-dot lines in FIG. 14).

The cylinder 465 is provided with a first limit switch 467, a second limit switch 468, a third limit switch 469 for detecting positions between the backmost positions (the opened state) and the forward-most positions (the closed state) of the seal block pieces 440R, 440L. The first limit switch 468 detects the backmost positions (the opened state) of the seal block pieces 440R, 440L and the second limit switch 468 detects that the seal block pieces 440R, 440L come to a stop at predetermined positions near the extruding stem 414.

The third limit switch 469 turns on when the seal block pieces come to the position where the seal block 440 is closed against the extruding stem 414 so as to actuate an electromagnetic switch valve 490 to connect the deaeration space 431 to the vacuum tank 420, thereby deaerating the inside of the container 401.

As described later, the seal block pieces 440R, 440L are each structured to be separated into an inner seal block piece 440A, positioned at an inner side of the seal block 440 and having sealing members 441 and 444 disposed on the inner surface thereof, and an outer seal block piece 440B, positioned outside the inner seal block piece 440A, for holding the inner seal block piece 440A. For preventing air infiltration between the contact surfaces 440*a* of the seal block pieces 440R, 440L when the seal block 440 is closed as shown by chain lines in FIG. 11, the contact surfaces 440*a* are provided with sealing members 446 (sheet-like sealants) attached thereon. For example, the sealing members 446 are preferably sponge-like sealants, having heat resistance and resiliency, made of silicon rubber or fluoro-rubber.

When the seal block 440 is closed, the seal block 440 comes into sealing contact with a protrusion 480 (described later) through the sealing members 446 attached to the contact surfaces 440A of the seal block pieces 440R, 440L and sealing members 441 disposed on the inner surfaces of the seal block pieces 440R, 440L and comes into sealing contact with the fixed dummy block 470 and an outer surface of the extruding stem 414 through sealing members 444.

Among the sealing members 441, 444, 446, the sealing members 441 and 444 are preferably made of a heat resistant and high deformable material, such as relatively hard string-like silicone rubber and string-like fluoro-rubber.

On the other hand, the sealing members 446 are preferably made of soft sponge-like rubber by comparison with the sealing members 441, 444, for example, heat resistant sponge-like material such as sponge-like silicone rubber sheet and sponge-like fluoro-rubber sheet.

Particularly, when the seal block 440 is closed relative to the extruding stem 414, the sealing members 444 are pulled in a direction of arrow because of the friction between the outer surface of the extruding stem 414 and the sealing members 444 as shown in FIG. 5B, thereby causing a space S between ends of the contact surfaces 440A.

In case where the sealing members 446 of sponge-like soft rubber (each 3 mm in thickness) are attached to the contact surfaces 440A of the seal block pieces 440R and 440L as shown in FIG. 5A, the sealing members 446 are compressed when the seal block 440 is closed and free ends of the sealing members 446 are about to project toward the extruding stem, thereby preventing the aforementioned space S. This effect is common to the sealing members 441. That is, a space on an outer surface of the protrusion 480 can be prevented by the sealing member 441.

When the seal block pieces 440R, 440L return to the backmost positions thereof as shown by solid lines in FIG. 11, a billet loader 511 (described later) can move out and in with the billet 413 mounted thereon. The seal block pieces 440R, 440L are each provided with a deaerating hole 445 which is connected to an end of a flexible pipe line 408*a*, the other end being connected to a fixed pipe line 408*b* through an electromagnetic switch valve 490. The fixed pipe line 408*b* is connected to a vacuum tank 420.

As shown in FIGS. 16 and 19, the container 401 is provided with a concavity 450 which is formed in the container tire 402 at the extruding stem 414 side and is coaxially engaged to the container liner 401*a*, and into which an insulator 447 formed in a doughnut-like configuration is inserted. An engaging member 451 having a protrusion 480 protruding, in a L shape in its section, toward the extruding stem 414 is mounted on the insulator 447 by bolts 452 spaced with a constant pitch.

Reference numeral 456 is a ring-like projection which acts as a stopper for preventing deformation of the insulator 447 when the engaging member 451 is attached to the end surface, at the extruding stem 414 side, of the container tire 402 by the bolts 452 after laying the engaging member 451 on the insulator 447 since the insulator 447 is made of relatively soft material. The insulator 447 also has a function as sealant for preventing air infiltration from its outside during vacuuming air in the container 401.

The container tire 402 is also provided with a heat insulating plate 448 disposed further outside the engaging member 451 by screws 454 with a pitch circle different from that of the bolts 452. The protrusion 480 is inserted into a heat insulating ring 453. The temperature of the outer surface of the heat insulating ring 453 is kept at 200° C. or less by superposing the insulator 447, the engaging member 451, and the heat insulating plate 448 which constitute a heat insulating seal block 455 and disposing the heat insulating ring 453 around the protrusion 480 of the engaging member 451. The temperature is quite low relative to the average of the temperature of the container 401 of 400° C.

Even when the sealing members 441 frequently come into contact with the heat insulating ring 453 according to the opening and closing of the two-piece seal block 440, this structure prevents the deterioration of the sealing members 441 due to heat history, prevents heat conduction from the container 401 to the vacuum aspirator 460, and prevents the seal block pieces 440R, 440L from rubbing against the surface of the heat insulating plate 448 disposed on the insulator 447 to allow the movement between the backmost positions and the forward-most positions. The insulator 447 is preferably made of siliceous material having fine porous structure, the engaging member 451 is preferably made of tool steel or heat resistant steel, and the heat insulating plate 448 is preferably made of high-functional resin.

Figure 21A:
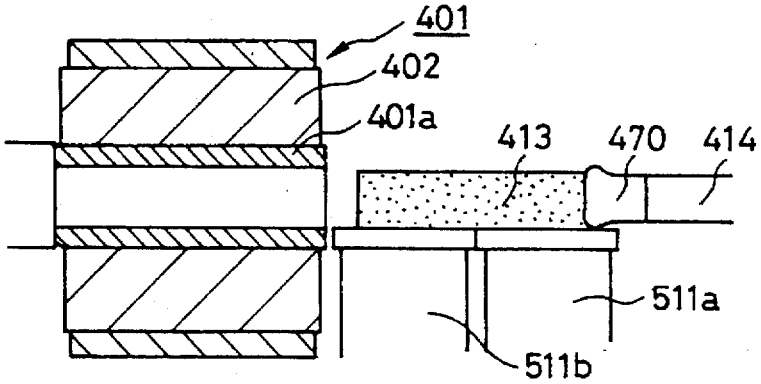
FIGS. 21A through 21E are views for explaining the mounting structure of a heat insulating seal block.
Figure 21B:
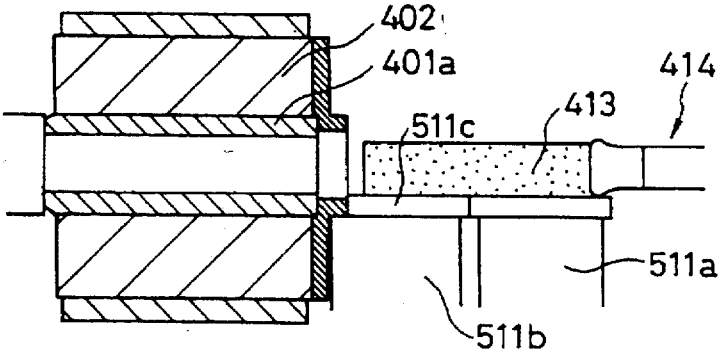

If the heat insulating seal block 455 is covers overall the end surface, at the extruding stem 414 side, of the container 401 of a general purpose extruder (shown in FIG. 21A) as shown in FIG. 21B, the end surface of the container 401 projects toward the extruding stem 414 so as to cause interference between the No. 2 billet loader 511*b* and the heat insulating seal block 455. Such interference may be prevented by lengthening the extruding stem 414 or moving the first billet loader 511 toward the extruding stem. However, it necessitates significantly remodeling of the first billet loader 511.

Additionally, it is expensive to cover the heat insulating seal block 455 overall and there is a problem of the strength since a lot of bolt holes must be formed in the end surface of the container 401 for mounting the heat insulating seal block 455 to the container tire 402.

Figure 21C:
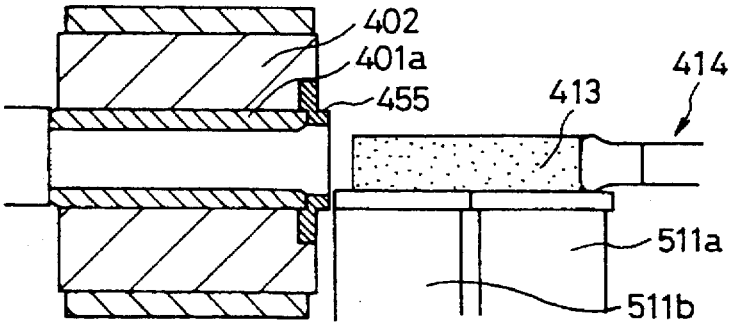

In this embodiment, as shown in FIG. 21C, the container tire 402 is provided with the concavity 450 formed in a doughnut configuration in which the heat insulating seal block 455 is inserted, thereby making the projection of the heat seal block 455 shorter, and a short billet liner 511*c* of the No. 2 billet loader 511*b* is provided not to interfere with the protrusion 480 of the engaging member 451 constituting the heat insulating seal block 455. In this embodiment, it is not limited to provide the short billet liner 511*c* not to interfere with the protrusion 480 as described above. It may dispose the billet loader 511 at a position not to interfere with the protrusion 480, when installing a new extruder.

Figure 21D:
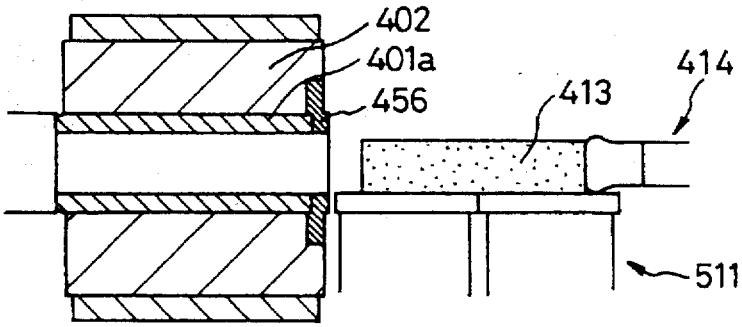
Figure 21E:
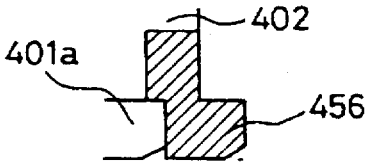

In addition, for restoring the container 401 in this embodiment to the container of general purpose extruder as shown in FIG. 21A, the heat insulating seal removed and a removed and a restoring block 456 is inserted into the concavity 450 by bolts (not shown) as shown in FIG. 21D and FIG. 21E.

In consideration of a case where the inside of the extruding stem 414 is not cooled, the inner diameter Y of the protrusion 480 disposed on the heat insulating plate 448 is structured to be larger than the inner diameter X of the container liner 401*a* as shown in FIG. 19 (X<Y).

This facilitates the deaeration of the inside of the container 401 since there is a ring-like space between Y-X even when the diameter of the large-diameter end portion 449 becomes the same as the inner diameter X of the container liner 401*a* by gluing aluminum residues on the surface of the large-diameter end portion 449. In case where the inside of the fixed dummy block 470 is cooled to make the outside surface 606 at 200°–250° C. or less by letting cooling water run in a cooling tube 591 (described later), the surface temperature of the large-diameter end portion 449 of the fixed dummy block 470 is cooled to 200°–250° C. or less so that the diameter of the large-diameter end portion 449 is smaller than the inner diameter X of the container liner 401*a* before next extrusion even when aluminum residues are glued on the surface of the large-diameter end portion 449 of the fixed dummy block 470 to make the diameter of the large-diameter end portion 449 larger, for example, the diameter of the large-diameter end portion 449 becomes the same as the inner diameter X of the container liner 401*a* just after the extrusion. Therefore, the deaeration space 431 as a deaerating path is kept also in this case.

Moreover, the protrusion 480 is provided with a tapered surface, the inner diameter of which is larger at the extruding stem 414 side to facilitate insertion of the large-diameter end portion 449 of the fixed dummy block 470 of the extruding stem into the container 401 with the billet 413 being easily pressed into the container 401. The container liner 401*a* is also provided with a tapered surface wherein an inner surface is larger at the protrusion 480 side and the tapered surface is smoothly connected to the inner surface of the protrusion 480.

Figure 20A:
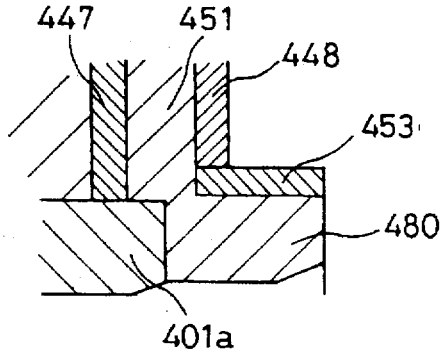
FIGS. 20A, 20B, 20C and 20D are enlarged sectional views illustrating configurations of the inside of the protrusion.
Figure 20B:
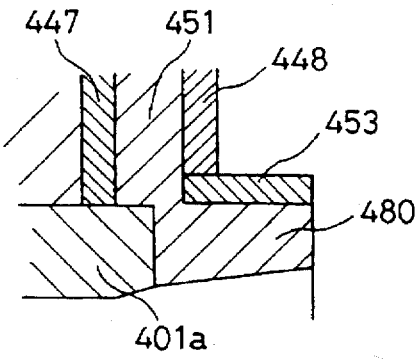
Figure 20C:
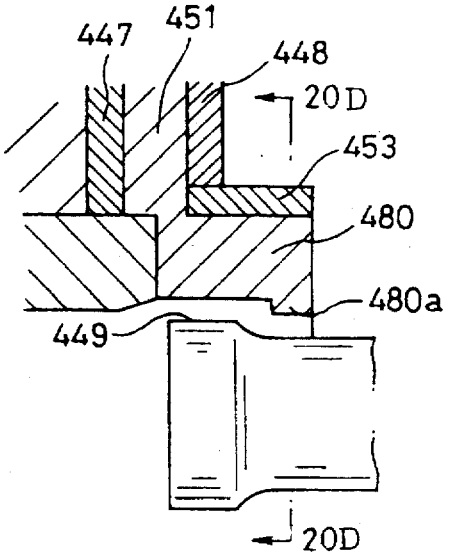
Figure 20D:
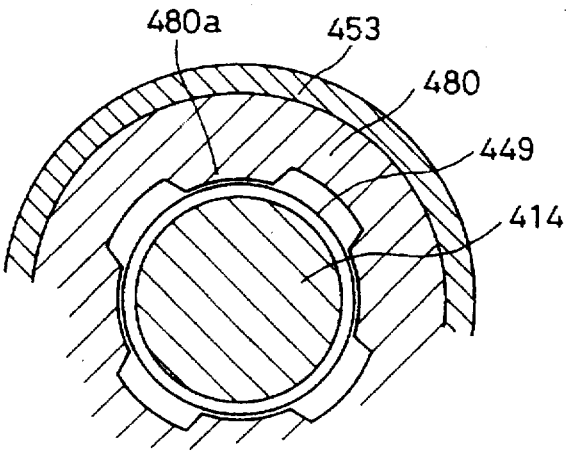

When the large-diameter end portion 449 of the fixed dummy block 470 passes through the inside of the protrusion 480, there is a ring-like space between the circular large-diameter end portion 449 and the inner surface of the circular protrusion 480. However, it is not limited to this structure, for example, the space may be an intermittent space formed by projections 480*a* disposed around the inner surface of the protrusion 480 as shown in FIG. 20C.

As described above, the engaging member 451 is provided with the protrusion 480 disposed on the surface at the extruding stem 414 side, corresponding to the container liner 401*a* so that the seal block 440 seals through the sealing members 441 when the seal block 440 is closed against the heat insulating ring 453 attached around the protrusion 480.

The insulating plate 448 is provided with the protrusion 480, front surface of which is formed in a ring-like configuration in a position corresponding to a container liner 401*a*. When the seal block 440 is closed, the protrusion 480 comes in sealing contact with the seal block 440 through the sealing members 441. Reference numeral 421 designates a vacuum pump and 422 designates a motor.

Another one of main features of the present invention is that there is no cover plate nor guide rail for the close motion of the seal block 440. The pivotable arm 463 pivots about the supporting shaft 463*c* to the backmost position by drawing the piston rod 462*a* of the movable hydraulic cylinder 462 with the seal block 440 being opened without interference with the No. 1 billet loader 511*a*.

The above structure facilitates the exchange of the container tire 402 and the container liner 401*a* and does not deteriorate the sealing performance because in case of scrapping off aluminum residues glued on the inner surface of a container liner 401*a* by the outer surface of the fixed dummy block 470 when the extruding stem 414 returns to the original position after extruding the billet 413, the scrapped aluminum residues just fall down from the edge of the inner surface of the protrusion 480 as shown in FIG. 6A and FIG. 6B, does not enter into a groove of the guide plate as the prior art which causes hitches to the close motion of the seal block 440.

In this embodiment, the extruder is provided with a cooler 491 for spraying coolant to the sealant such as the sealing members 441, 444.

The seal block pieces 440R, 440L are each structured to be separated into an inner seal block piece 440A, positioned at an inner side of the seal block 440 and having sealing members 441 and 444 disposed on the inner surface thereof, and an outer seal block piece 440B, positioned outside the inner seal block piece 440A, for holding the inner seal block piece 440A. The outer seal block piece 44B is attached to the inner seal block piece 44A by tap bolts 495 with a suitable pitch.

As shown in FIG. 16, the inner seal block piece 440A is provided with a half-circle groove formed inside thereof and provided with a covering 498 to form a first coolant path 496. The first coolant path 496 is provided with a plurality, in slits radially extending inwardly of which openings toward the sealing members 444 are first gas outlets 500 of the first coolant path 496 to suitably cool the sealing members 444.

There is also a second coolant path 497 between the inner seal block piece 440A and the outer seal block piece 440B. The second coolant path 497 is connected to the first coolant path 496 to correspond to the first coolant path 496 and is provided with a plurality of second gas outlet 501 toward the sealing members 441 to spout out coolant from the second gas outlets 501 to cool the sealing members 441.

Though the first coolant path 496 and the second coolant path 497 are connected each other in this embodiment, the first coolant path 496 and the second coolant path 497 may be separately disposed.

The outer seal block piece 440B is connected to one end of a flexible pipe line 492. The other end of the flexible pipe line 492 is connected to a fixed pipe line 494 through an electromagnetic switch valve 493. The fixed pipe line 494 is connected to a coolant supply source (not shown). Cooling gas as the coolant is spouted out from the first gas outlets 500 and the second gas outlets 501 regardless whether the seal block 440 is opened or closed.

The description will now be made as regard to the billet loader 511 with reference to FIG. 11 and FIG. 18.

As shown in FIG. 11, there are a first billet loader 511 and a second billet loader 540. The second billet loader 540 comprises a telescopic cylinder 545, a movable frame 546, linear guides 547, a holder 554, a pair of billet loader swing arms 549, a pair of pivotable stoppers 550, a pair of frame back stoppers 551, a pair of stopper back stoppers 552, and a fixed frame 553.

The second billet loader 540 receives the billet 413 conveyed by a billet carrier 541 when the second billet loader 540 is in a forward-most position as shown by chain lines in FIG. 11 and pivots to the same position of the backmost position of the first billet loader 511 to hand over the billet to the first billet loader 511 disposed on the side of the container 401.

That is, the billet carrier 541 has a slide (not shown) disposed near the base of the extruder and a delivery holder 543 to deliver the billet 413 to the second billet loader 540 through the slide.

The delivery holder 543 has a V-like billet receiving portion and is pivotally supported by a supporting shaft 544 to allow the pivotal movement of the receiving portion. The delivery holder 543 is actuated by a cylinder mechanism (not shown) so that, first, it receives the billet 413 with the opening of the V-like billet receiving portion facing the upstream of the slide and pivots downward to send out the billet 413 to the second billet loader 540.

The second billet loader 540 is positioned to face the billet carrier 541 so that the billet carrier 541 delivers the billet 413 one by one to the second billet loader 540.

The telescopic cylinder 545 having a stretchable rod 545 is disposed on an end of the fixed frame 553 in the axial direction. The movable frame 546 is connected to the end of the rod 545*a* through a connecting member 557.

The linear guides 547 are disposed on the both sides of the fixed frame in the longitudinal direction. The movable frame 546 is movable along the linear guides.

The bar-like frame back stoppers 551 are disposed on one side 555 of the fixed frame 553 at the upper side to regulate the backward limits of the movable frame by rotating adjustable screws 556.

On the other hand, the bar-like stopper back stoppers 552 are disposed on the side 555 of the fixed frame 553 at the lower side to regulate the backward limits of the pivotable stoppers 550 by rotating adjustable screws 558. The rear ends of the billet loader swing arms 549 come into contact with the pivotable stoppers 550. Then the billet loader swing arms 549 pivot about a pivot shaft 560 to deliver the billet 413, which is placed on the billet holder 554 disposed on the end of the billet loader swing arms 549, to an intermediate stopping position.

Hereinafter, the fist billet loader 511 will be now described.

The first billet loader 511 receives the billet 413 from the second billet loader 540 at the intermediate stopping position and delivers the billet 413 to a billet loading opening 526. The billet loader 511 is mounted to a fixed frame 561 projecting from the container 401 toward the extruding stem 14 and comprises a No. 1 billet loader 511*a* and the No. 2 billet loader 511*b*, which are integrally movable with the container, as shown in FIG. 18.

The first billet loader 511 comprises the No. 2 billet loader 511*b* which is pivotally positioned adjacent to the container 401 and the No. 1 billet loader 511*a* which is pivotally positioned adjacent to the No. 2 billet loader 511*b*.

The first billet loader 511 disposed corresponding to the second billet loader 540 and is provided with a first swing arm 562 of the No. 1 billet loader 511*a* and a second swing arm (not shown) of the No. 2 billet loader 511*b*.

The description will be made as regard only to the first swing arm 562. One end of the first swing arm 562 is pivotally fixed by a supporting shaft 563 disposed below one of below tight rods 529. The fixed frame 561 is provided with an upper stopper 564 at the upper end thereof and a lower stopper 565 at the lower end thereof. The lower stopper 565 regulates the lowermost position of the first billet loader 511 to facilitate receiving from the second billet loader 540 with the first billet loader 511 and the second billet loader 540 being in the same level.

On the other hand, the upper stopper 564 regulates the uppermost position of the first billet loader 511 to facilitate loading of the billet 413 to the billet loading opening 526 when the first billet loader 511 delivers the billet 413, received from the second billet loader 540, from the intermediate stopping position to the billet loading opening 526.

The first swing arm 562 of the No. 1 billet loader 511*a* is connected to a piston rod 566*a* of a first hydraulic cylinder 566 so that the first swing arm 562 is moved between the lowermost position shown by chain lines and the uppermost position shown by solid lines in FIG. 11 by the stretch motion of the piston rod 566*a*. Reference numeral 567 designates a second hydraulic cylinder which is connected to the second swing arm of the No. 2 billet loader 511*b* through a piston rod 567*a*.

The first swing arm 562 is provided with a first billet holder 568 at the end thereof for holding the billet 413. The first billet holder 568 has three seat plates 569 for supporting the bottom of the billet 413, thereby securely holding the billet 413.

The first billet holder 568 is provided with a crimping arm 571 fixed to one end thereof by a supporting shaft 570.

A connecting member 572 fixed to the cramping arm 571 at a constant angle with the lower edge of the cramp arm 571 is connected to an end of a rod of a compensating cylinder for cramping or releasing the billet 413 so that the cramping arm 571 can pivot according to the stretch motion of the rod. Therefore, the billet 413 is supported at least at three points by plates 569 and the cramping arm 571 in the first billet holder 568, thereby preventing the billet from coming off when delivered.

As for the structure of the extruding stem 414, there are two cases: where the fixed dummy block 470 and the extruding stem 414 is connected through a bayonet block 580 and where the fixed dummy block 470 is directly connected to the extruding stem 414 by screwing.

In this embodiment, the case where the fixed dummy block 470 and the extruding stem 414 are connected through the bayonet block as shown in FIG. 8 will be described as a typical structure.

The fixed dummy block 470 is fixed to the front surface of the extruding stem 414 and is slidably disposed in the container liner 401*a*.

The rear end of the extruding stem 414 is fixed to a cross head 475 through a stem holder 473 and a pressure ring 474 as shown in FIG. 10.

The bayonet block 580 is disposed on the front surface of the extruding stem 414. A distal end of a connection rod 581 having a circular section is screwed into the rear half of the bayonet block 472 so that the connection rod 581 is attached to the bayonet block 580. The connection rod 581 has a large-diameter portion 582 at the rear end thereof. The large-diameter portion 476*a* is fixed to a hole formed in the rear end portion of the extruding stem 414 so that tapered surfaces therebetween are engaged each other.

The front half of the bayonet block 580 has a structure of a bayonet type as shown in FIG. 8 and is provided with, for example, three protrusions 586 disposed at equal spaces.

On the other hand, a dummy boss 587 is provided with concavities 588 disposed at equal spaces to engage the protrusions 586. Installing the dummy boss 587 to the bayonet block 580 is securely and quickly accomplished by engaging the protrusion 586 of the bayonet block 580 with the concavities 588 of the dummy boss 587 and rotating the dummy boss 587 about 60 degree.

The connection rod 581 is provided with a through hole extending in the axial direction, in which a feed water pipe 589 and a drain pipe 590 are disposed. The feed water pipe 589 and the drain pipe 590 constitute a cooling pipe 591. One ends of the feed water pipe 589 and the drain pipe 590 are secured to holes 593, 594 of a cooling pipe end block 592 by welding and the other ends extend to the inside of the pressure ring 584. The end of the feed water pipe 589 is connected to a cooling water pump (not shown) through a path 595 of a pipe in the pressure ring 584, a valve 596, and a pipe line 597. The end of the drain pipe 590 is connected to a drain port 599 through a path 598 of a pipe in the pressure ring 584.

There is a slight space between the inner surface of the extruding stem 414 and the outer surface of the connection rod 581 to keep the flexibility of the axis of the connection rod 581. There is also slight spaces between the inner surface of the connection rod 581 and the outer surfaces of the feed water pipe 589 and drain pipe 590 not to directly cool the connection rod 581. Additionally, there is also a slight space between the inner surface of the connection rod 581 and the cooling pipe end block 592 to keep the flexibility of the axis of the connection rod 581.

In this case, since the feed water pipe 589 and the drain pipe 590 are inserted into the through hole formed in the connection rod 581, the connection rod 581 is not directly coextruding the temperature difference between the extruding stem 414 and the connection rod 581 is therefore a little so as not to impair the flexibility of the axis of the fixed dummy block 470.

The hole 593 extends over the cooling pipe end block 592. The front end of the hole 593 is connected to a hole 600 allowing the outward flow through a cooling pipe end block 592. The dummy boss 587 is provided with a central through hole 601 into which a small cylindrical protrusion 603 formed in a middle portion of a core block 602 is inserted. The core block 602 comes in tight contact with the dummy boss 587 by engaging a connection nut 604 to a screw thread formed in the protrusion 603 from the rear side of the dummy boss 587 and screwing up the connection nut 604.

The dummy boss 587 is provided with a cylindrical outer ring 605 integrally fixed to the front end periphery thereof. There is a space between the rear end surface of the core block 602 and the front end surface of the dummy boss 587 to correspond to the differential between the distal end of the outer ring 605 and an outside surface 606 of the core block 602. Therefore, as the core block 602 is pressed backward during extrusion, the rear end surface of the core block 602 comes into contact with the front end surface of the dummy boss 587. The outer ring 605 is stretched and comes into contact with the inner surface of the container to prevent the billet 413 to flow toward the extruding stem 414 of the fixed dummy block 470.

The core block 602, the outer ring 605, and the dummy boss 587 constitute the fixed dummy block 470. Therefore, the outer surface of a front portion of the outer ring 605 is designed to substantially come into contact with the inner surface of the container 401. The core block 602 has a tapered portion 607, wherein the front portion is wider than the rear portion, to be in tight contact with a tapered portion disposed on the front inner surface of the outer ring 605. The center axial portion of the core block 602 and the protrusion 603 is provided with a path 608 which cooling water supplied from the feed water pipe 589 passes through. The distal end of the path 608 extends to a portion near the outside surface 606 of the core block 602.

The path 608 is provided with a plurality of cooling paths 609 (eight cooling paths in this embodiment) extending radially from the end of the path 608 to the outer ring 605. Paths 610 extend in the axial direction near the outer portion of the extruding stem 414 from the outer ends of the paths 609 over the dummy boss 587 and the core block 602 and are connected to the hole 600 of the cooling pipe 591. Reference numerals 611, 612, 613 designate plugs and 615, 616, 617 designate heat resistant O-rings, respectively.

Hereinafter, the operation of the extruder mentioned above will be described.

First, before starting the upsetting, a coolant supplying device not shown is actuated to introduce the coolant such as cooling water to the cooling paths 609 so as to cool the fixed dummy block 470 form the inside thereof. The cooling water is entered from the rear side of the extruding stem 414 to pass through the feed water pipe 589 in the connection rod 581 of the extruding stem 414, the path 608, the cooling paths 609, the path 610, and the hole 600 and is then drained from the rear side of the extruding stem 414 through the drain pipe 590. According to the present invention, the cooling paths 609 are radially disposed near the outside surface 606 from the central portion of the core block 602, thereby lowering the temperature of the outside surface 606 of the fixed dummy block 470 during the upsetting to 200°–230° C. by the cooling water.

Therefore, this prevents the thermal expansion of the large-diameter end portion 449 of the fix dummy block 470 during the extrusion. Since a space between the inner surface of the container 401 and the outer surface of the large-diameter end portion 449 of the fixed dummy block 470 is kept whenever the deaeration is performed from the extruding stem 414 side, the deaeration space 431 of the container 401 is sufficiently deaerated.

Figure 22A:
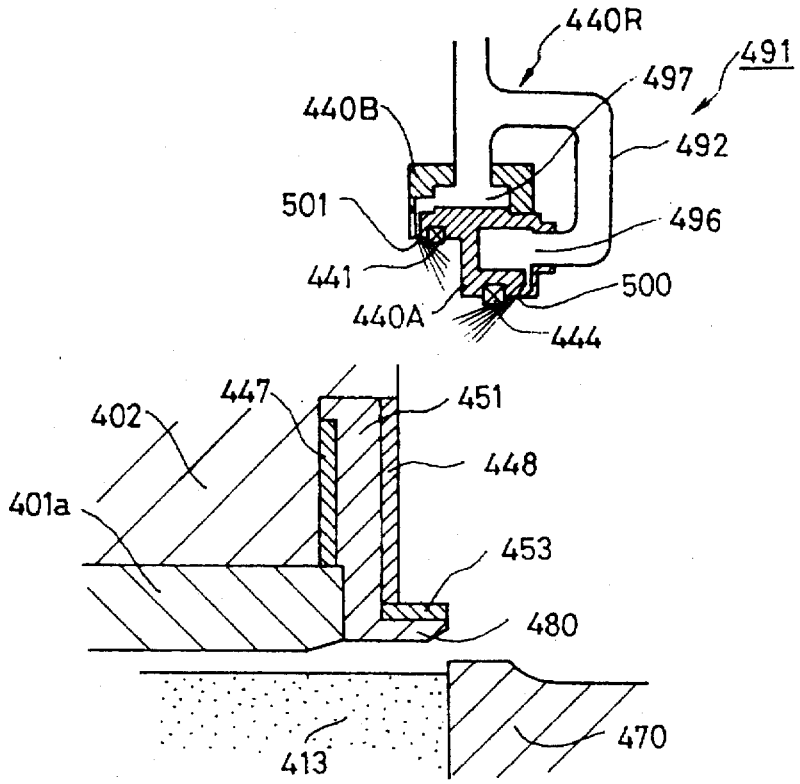
FIGS. 22A and 22B are views illustrating the opening and closing of the seal block and the condition of spraying coolant.

Once the fixed dummy block 470 is cooled to a predetermined temperature, as shown in FIGS. 22A, 22B, 23A, 23B, the seal block pieces 440R, 44L are moved from backmost positions (shown by solid lines in FIG. 11) to the forward-most positions (shown by two-dot chain lines in FIG. 11) according to the stretch motion of the piston rod 465*a* of the seal block closing hydraulic cylinder 465. As shown in FIG. 22A, the sealing members 441 and 444 are cooled by cooling gas spouted out from both of the first gas outlets 500 formed in the inner seal block 440A and the second gas outlets 501, thereby preventing the deterioration of the sealing performance of the sealing members 441 and 444 even when the sealing members 441 and 444 come in contact with the outer surface of the fixed dummy block 470 and the outer surface of the heat insulating ring 453, respectively, with the seal block 440 being closed.

As the cylinder 465 is supplied with pressure oil at this point, the cylinder 465 advances the seal block pieces 440R, 440L with spraying cooling gas to the sealing members 444 and 441 from the first gas outlets 500 and the second gas outlets 501.

Figure 22B:
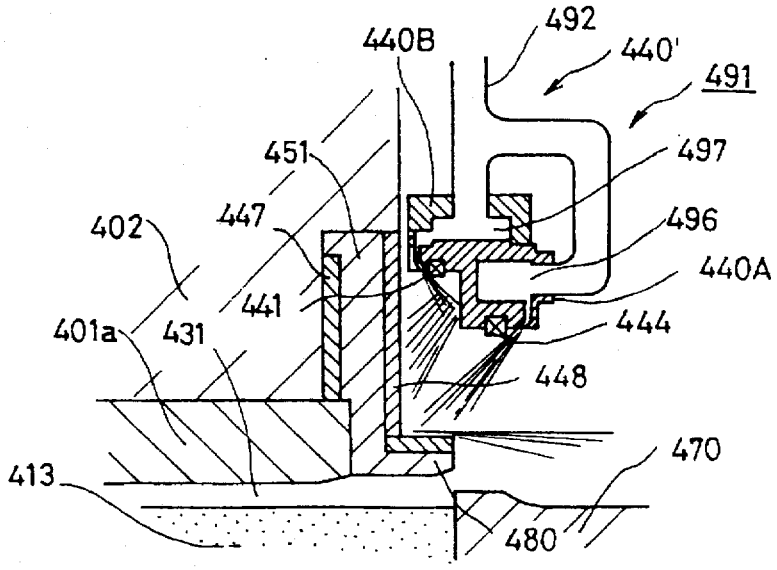

When the seal block pieces 440R, 440L get closer to the extruding stem 414 and the fixed dummy block 470, the cooling gas spouted out from the first gas outlets 500 and the second gas outlets 501 blows off dusts and residues glued on the outer surfaces of the heat insulating plate 448 and the heat insulating ring 453 (as shown in FIG. 22B).

Figure 23A:
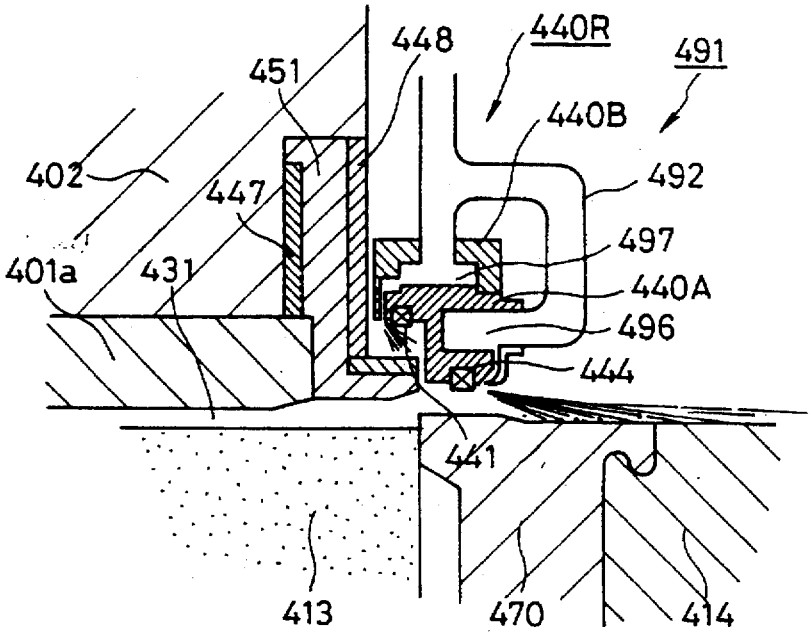
FIGS. 23A and 23B are views illustrating an operation following FIGS. 22A and 22B.

When the seal block pieces 440R, 440L are further close to the extruding stem 414 and the fixed dummy block 470, the outer surfaces of the extruding stem 414 and the fixed dummy block 470 are cooled by the cooling gas spouted out from the first gas outlets 500 and the second gas outlets 501 and further dusts and residues glued on the outer surfaces of the heat insulating plate 448 and the heat insulating ring 453 are blown off by the pressure of the cooling gas (as shown in FIG. 23A).

Figure 23B:
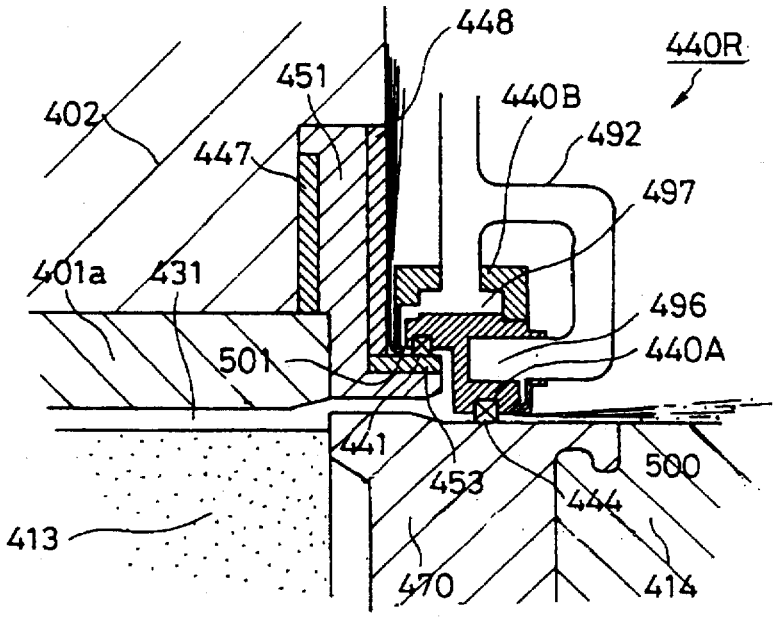

Also after the seal block pieces 440R, 440L come into contact with the fixed dummy block 470 and the heat insulating ring 453, the cooling gas is continuously spouted out from the first gas outlets 500 and the second gas outlets 501. The cooling gas is blocked from entering into the deaeration space 431 by the sealing members 441 and 444 so that the cooling gas flows outward as shown in FIG. 23B.

The billet 413 is squeezed as follows. First, the piston 437 is moved in the left direction by supplying pressure oil to a rod side of the container cylinder 433 to advance the container 401, which was spaced apart from the die 403, so that the container 401 comes into contact with the die 403. After that, the first swing arm 562 is raised up by drawing the piston rods 566*a* and 567*a* of the first hydraulic cylinder 566 and the second hydraulic cylinder 567 of the first billet loader 511 so that the billet 413 is positioned to be loaded to the billet loading opening 526 with the billet 413 being held by the first billet holder 568 and the second billet holder (not shown).

As described above, in an initial stage, the seal block pieces 440R, 440L are positioned at the backmost positions as shown by solid lines in FIG. 11. The limit switch 647 is still ON. The billet loader 511 rises from this state with holding the billet 413 thereon. Then, the extruding stem 414 starts to move forward at a constant speed. At the same time, the piston rod 465*a* is projected so that the two-piece seal block 440 starts to close. The second limit switch 468 turns on at a predetermined position where the seal block pieces 440R, 440L get radially closer to the extruding stem 414 so that the seal block pieces 440R, 440L come to a stop. On the other hand, the billet 413 is pressed into the container 401 according to the advance of the extruding stem 414 and moves toward the die 403. On the way, the No. 1 billet loader 511*a* and the No. 2 billet loader 511*b* are lowered to a position where the No. 1 billet loader 511*a* and the No. 2 billet loader 511*b* do not interfere with the seal block pieces 440R, 440L. At this point, the extruding stem 414 continuously moves forward. Once the extruding stem 414 comes to a predetermined position, the extruding stem 414 is decelerated by a rotary encoder (not shown).

As the extruding stem 414 is decelerated, electromagnetic valve (not shown) disposed above an introduction tube of the seal block closing hydraulic cylinder 465 is actuated to advance again the seal block pieces 440R, 440L to the forward-most position where the seal block pieces 440R, 440L stop. At this point, the extruding stem 414 presses the billet 413 into the container to the predetermined position.

As described before, since the outer surface of the fixed dummy block 470 is already cooled to approximately 200°–250° C. at this point, a rear end portion of the billet 413 being in contact with the fixed dummy block 470 is cooled when starting the upsetting. After starting the upset, the rear end portion, at the extruding stem 414 side, of the billet 413 swells so as to come into close contact with the container 401.

When the upsetting is performed, the rear end portion of the billet 413 is cooled so that the fluidity thereof is decreased and the frictional resistance between the front end surface of the fixed dummy block 470 and the rear end portion of the billet 413 is therefore increased, thereby preventing the surface of the rear end portion of the billet 413 from flowing inside thereof. Therefore, air of small volume existing on the surface of the rear end portion is prevented from being trapped into the rear end portion of the billet 413. Thus, the air causing blisters can be sufficiently eliminated by preventing the trapping the surface of the rear end portion of the billet 413 and air existing there by cooling the fixed dummy block 470, and by deaerating the space between the surface of the billet 413 and the inner surface of the container 401.

After that, as the two-piece seal block 440 is closed against the fixed dummy block 4470 and the heat insulating ring 451, the third limit switch 469 turns on to drive the vacuum aspirator 460 and actuate the electromagnetic switch valve 490 so as to allow the communication between the vacuum aspirator 460 and the deaeration space 431, which is formed among the container 401, the die 403 and the billet 413.

Air in the deaeration space 431 passes through the deaerating holes 445 formed in the seal block 440 and is vacuumed into the vacuum tank 420 through the pipe line 408*a*, the electromagnetic switch-valve 490 disposed above the pipe line 408*a*, and the pipe line 408*b*. Therefore, air is quickly and sufficiently exhausted from the deaerating holes 445 of the seal block 440.

The inside of the vacuum tank 420 is already in a vacuumed state of less than 5 torr by the vacuum pump 421. When the billet 413 is pressed into the container 401 according to the advance of the extruding stem 414 and a large-diameter end portion 449 of the fixed dummy block 470 passes through the seal block 440, the seal block 440 is closed.

Once the electromagnetic switch valve 446 is actuated, the residual air in the container 401 is vacuumed by the vacuum tank 420. After 0.2–0.5 seconds, the inside of the container 401 becomes 5–30 torr. The extruding stem 414 further moves forward so that the distal end of the billet 413 comes into contact with the die 403, thereby making the hydraulic pressure in a side cylinder higher. When the hydraulic pressure becomes to a predetermined value, a main cylinder (not shown) replaces the side cylinder to supply hydraulic pressure. Thus, the upsetting is completed.

After that, the extruding stem 414 continuously moves forward to squeeze the billet 413. Soon after that, the extrusion is started to extrude an end product from the die 403. Upon completion of the upsetting for the billet, after a suitable period from starting the extrusion by the advance of the extruding stem 414 (for example, at a point where ⅓ length of the initial length of the billet 413 is extruded), the deaeration is stopped and the seal block 440 is opened, that is, the seal block pieces 440R, 440L return to the backmost positions thereof. After that, the extrusion by the extruding stem 414 is still performed to complete the extrusion.

While the billet 413 is squeezed from the die 403 to make the end product, the first billet holder 568 of the first billet loader 511 is lowered to the lower-most position, while the rod 545*a* of the telescopic cylinder 545 is expanded to horizontally move the billet holder 554 of the second billet loader 540 to the forward-most position to face the billet carrier 541. Then, the delivery holder 543 of the billet carrier 541 pivots so that the next billet 413 is entered into the billet holder 554. In this condition, the rod 545*a* of the telescopic cylinder 545 is drawn fully. The first billet holder 568 is moved from the lower-most position to the intermediate stopping position.

When the container 401 comes into contact with the die 403, the holder 554 disposed at the end of the swing arm 549 of the second billet loader 540 pivots to the position corresponding to the lower-most position of the first billet loader 511. The second billet loader 540 then hands over the billet 413 to the first billet loader 511.

As apparent also from the above description, according to the second embodiment, (1) since the two-piece seal block disposed on the end surface of the container at the extruding stem side is moved from a position near the tight rod to the extruding center position and after that the two-piece seal block is closed by another cylinder, the two-piece seal block can be sufficiently moved to a position where the seal block does not interfere during the exchange of container liner, thereby proving easy operation. Additionally, the seal is sufficient so that the degree of vacuum is higher and the deaeration is sufficiently performed, thereby preventing occurrence of blister and significantly improving the yield of the end products;

(2) the inner surface of the ring-like protrusion at the extruding stem side is provided with an annular deaerating groove so that the inside of the container can be deaerated even when aluminum residues are glued on the surface of the large-diameter end portion of the fixed dummy block to make the diameter of the large-diameter end portion larger, thereby stably extruding the material without blister and further significantly improving the yield of the end products;

(3) the sealing is performed by the two-piece seal block in a short time, thereby reducing the idle time;

(4) the two-piece seal block is spaced apart from the ring-like protrusion and the extruding stem just before the two-piece seal block is closed, thereby making the lives of the sealing members longer;

(5) in case of scrapping off aluminum residues by the outer surface of the fixed dummy block when the extruding stem is returned to the original position after extruding the billet, the scrapped aluminum residues just fall down out of the container, not enter into a groove of the guide plate as the prior art, thereby keeping the higher sealing performance;

(6) this structure does not necessitate the verp cycle as the prior art, thereby reducing the idle time; and (7) the end surface of the container at the extruding stem side is provided with a doughnut-like groove formed therein and the smallest heat insulating seal block made of heat insulating material is inserted in the doughnut-like groove, thereby preventing heat transfer from the container, and the heat insulating seal block is attached to a part of the end surface of the container so that fewer bolt holes formed in the end surface of the container is enough, thereby preventing deterioration of the mechanical strength; and (8) the outer surface of the fixed dummy block is cooled to the predetermined temperature so that the rear end portion of the billet is also cooled, thereby preventing the metal flow of the billet and thus preventing occurrence of blister.

What is claimed is:

1. An extruder for a billet comprising:

a cylindrical container adapted to receive the billet therein and having an end surface;

an extruding stem to be entered into the cylindrical container through the end surface of the cylindrical container;

guide rods situated near the end surface of the cylindrical container and extending perpendicular to an axial direction of the container;

a two-piece seal block disposed on the end surface of said container and formed of two block pieces, each block piece having at one side a contact surface with a seal member made of a heat resistant and resilient material and at a side away from the contact surface through rings, said guide rods passing through the through rings of the block pieces to guide the block pieces for opening and closing the block pieces so that when the block pieces are closed perpendicular to the axial direction of the container along the guide rods, the seal members of the block pieces contact the extruding stem and the container;

vacuum deaerating holes formed in the block pieces of the seal block for removing air therethrough; and a fixed dummy block attached to an end of the extruding stem and having an internal cooling function at a front portion thereof for cooling the dummy block and a rear portion of the billet.

2. An extruder as claimed in claim 1, further comprising an insulating plate attached to the cylindrical container and having a protrusion at a radially inner side thereof, said protrusion extending in the axial direction of the container and having an outer surface, said seal member having a first sealing member contacting said outer surface of the protrusion and a second sealing member contacting an outer surface of the extruding stem.

3. An extruder as claimed in claim 1, wherein said vacuum deaerating hole is connected to a vacuum tank.

4. An extruder as claimed in claim 1, wherein said fixed dummy block and said extruding stem are provided with cooling paths extending to a forward end of the dummy block, through which cooling water passes to cool the fixed dummy block.

5. An extruder as claimed in claim 1, wherein the front end surface of said fixed dummy block is cooled to 250° C. or less.

6. An extruder for a billet comprising:

a container having a container liner adapted to receive the billet therein and having an end surface;

a ring-shape protrusion disposed on the end surface of the container, an extruding stem to be entered into the container liner through the end surface of the container;

guide rods situated near the end surface of the container and extending perpendicular to an axial direction of the extruding stem; and a two-piece seal block disposed on the end surface of said container and formed of two block pieces, each block piece having at an inner side a step shape portion, at a side away from the inner side through rings and a seal member attached to the step shape portion, said guide rods passing through the through rings of the block pieces to guide the block pieces for opening and closing the block pieces so that when the block pieces are closed perpendicular to the axial direction of the extruding stem along the guide rods, the seal members attached to the step shape portions of the block pieces contact outer surfaces of the extruding stem and the ring-shape protrusion to seal a deaeration space in the container liner.

7. An extruder as claimed in claim 6, wherein said seal block is provided with a vacuum deaerating hole for eliminating residual air in the container wherein said vacuum deaerating hole is connected to a vacuum pump.

8. An extruder as claimed in claim 6, said seal member has heat resistance and resiliency and attached to contact surfaces of seal block which come into contact with each other when said seal block is closed.

9. An extruder as claimed in claim 6, wherein when said seal block is opened, said seal block can be moved not to interfere with a billet loader on which the billet to be loaded is placed and not to interfere with exchange of said container liner.

10. An extruder for a billet comprising:

a container having a container liner adapted to receive the billet therein and having an end surface;

a ring-shape protrusion disposed on the end surface of the container, an extruding stem to be entered into the container liner through the end surface of the container;

a ring-shape seal block formed of a pair of seal block pieces disposed near the container at a side of the extruding stem, said seal block pieces being opened and closed by swinging motion in a direction perpendicular to an axial direction of the extruding stem and having step shape portions with sealing members to abut against outer surfaces of the ring-shape protrusion and the extruding stem at the same time when the seal block pieces are closed, said seal block pieces contacting the outer surfaces of the ring-shape protrusion and the extruding stem at the same time through the sealing members to seal a deaerating space in the container liner; and a hydraulic cylinder attached to the seal block for opening and closing the seal block pieces, said hydraulic cylinder having a rod such that when said rod is moved linearly, the seal block pieces rotate and move between a closed position and a retracted rear position.

11. An extruder as claimed in claim 10, wherein said seal block is provided with a vacuum deaerating hole for eliminating residual air in the container wherein said vacuum deaerating hole is connected to a vacuum pump through a pipe line.

12. An extruder as claimed in claim 10, wherein a fixed dummy block provided with an internal cooler for cooling said fixed dummy block is attached to the extruding stem.

13. An extruder as claimed in claim 10, wherein said seal block is provided with a cooler for cooling said sealing member.

14. An extruder as claimed in claim 10, wherein said ring-like protrusion is provided with a deaerating groove formed in an inner surface thereof at the extruding stem side, said deaerating groove being formed in a circular shape, an inner diameter of which is larger than the outer diameter of said fixed dummy block fixed to an end of said extruding stem.

15. An extruder as claimed in claim 10, wherein said seal block pieces are each structured to be separated into an inner seal block piece, positioned at an inner side of the seal block and having said sealing member, and an outer seal block piece, positioned outside the inner seal block piece to hold the inner seal block piece, wherein said inner seal block piece has a first coolant path formed radially and covered by a lid, a second coolant path between said inner seal block piece and said outer seal block piece, and gas outlets for spraying coolant to said sealing members and for blowing off materials attached thereto.

16. An extruder as claimed in claim 10, wherein said seal block pieces are disposed above said extruding stem.

17. An extruder as claimed in claim 10, wherein said seal block is provided with seal block pieces pivotally mounted for closing and opening said seal block, said seal block pieces pivot so as to clamp the outer surface of said ring-like protrusion and the outer surface of the fixed dummy block or the extruding stem through the sealing members when said seal block is closed.

18. An extruder as claimed in claim 10, further comprising a guide ring disposed at the end face of said container facing toward said stem, and guide rods disposed above and under the seal block respectively, said guide rods being capable of sliding sidewardly and linearly on said seal block, whereby said seal block pieces are moved apart from and getting closer to each other by the guide rod and said cylinder.

19. An extruder as claimed in claim 10, wherein said ring-shape seal block is provided with gas outlets inside thereof for spraying coolant to said sealing members and for blowing off materials attached thereto.

* * * * *